US009089011B2

(12) United States Patent
Steininger et al.

(10) Patent No.: US 9,089,011 B2
(45) Date of Patent: Jul. 21, 2015

(54) ENABLEMENT PERIOD CONTROLLED LIGHTING APPLIANCE

(71) Applicant: Sonopro Power & Light, Inc., Fort Collins, CO (US)

(72) Inventors: John Steininger, Fort Collins, CO (US); Douglas Vilsack, Denver, CO (US); David Gelvin, Littleton, CO (US); Timothy Tillson, Fort Collins, CO (US)

(73) Assignee: SONOPRO POWER & LIGHT, INC., Fort Collins, CO (US)

( * ) Notice: Subject to any disclaimer, the term of this patent is extended or adjusted under 35 U.S.C. 154(b) by 49 days.

(21) Appl. No.: 13/749,406

(22) Filed: Jan. 24, 2013

(65) Prior Publication Data

US 2013/0200811 A1 Aug. 8, 2013

Related U.S. Application Data

(60) Provisional application No. 61/594,496, filed on Feb. 3, 2012.

(51) Int. Cl.
*H05B 37/02* (2006.01)

(52) U.S. Cl.
CPC ..... *H05B 37/02* (2013.01); *H05B 37/0245* (2013.01)

(58) Field of Classification Search
CPC .. H05B 37/02; H05B 37/0245; H05B 7/0227; H05B 37/0236
USPC ..... 315/291, 307, 154, 158, 159; 705/39, 705/35; 362/183, 276
See application file for complete search history.

(56) References Cited

U.S. PATENT DOCUMENTS 6,191,501 B1 * 2/2001 Bos ..... 307/64
6,756,765 B2 6/2004 Bruning (Continued)

FOREIGN PATENT DOCUMENTS

CN 1251188 4/2000
CN 102176723 9/2011

(Continued)

OTHER PUBLICATIONS

International Preliminary Report on Patentability for PCT/US2013/023288 mailed Aug. 14, 2014, 6 pages.

(Continued)

*Primary Examiner* — Douglas W Owens
*Assistant Examiner* — Borna Alaeddini
(74) *Attorney, Agent, or Firm* — Kilpatrick Townsend & Stockton LLP

(57) ABSTRACT

Various arrangements of a rechargeable lighting appliance are presented. The rechargeable lighting appliance may include a light. A rechargeable battery may be connected with the light. The rechargeable lighting appliance may include a communication interface configured to receive an enablement period. The rechargeable lighting appliance may include a non-transitory machine-readable storage device configured to store an indication of the enablement period. The rechargeable lighting appliance may include one or more processors. The one or more processors may be configured to control a mode of the rechargeable lighting appliance. The mode may be configured to be set to a first mode or a second mode. The first mode may permit illumination of the light at least partially based on activation of the enablement period stored by the non-transitory machine-readable storage device. The second mode may allow for unlimited illumination of the light without activation of the enablement period.

21 Claims, 15 Drawing Sheets

(56) References Cited

U.S. PATENT DOCUMENTS

| | | | | |
|---|---|---|---|---|
| 8,002,427 | B2 | 8/2011 | Lavigne | |
| 8,489,481 | B2 * | 7/2013 | Moore et al. | 705/35 |
| 2005/0131810 | A1 * | 6/2005 | Garrett | 705/39 |
| 2010/0214774 | A1 | 8/2010 | Liu | |
| 2011/0070829 | A1 * | 3/2011 | Griffin et al. | 455/41.1 |
| 2013/0212005 | A1 * | 8/2013 | Marincola et al. | 705/39 |

FOREIGN PATENT DOCUMENTS

| | | | |
|---|---|---|---|
| KR | 10-2011-0134571 | A | 12/2011 |
| WO | 2011155672 | A1 | 12/2011 |
| WO | 2013/116115 | A1 | 8/2013 |

OTHER PUBLICATIONS

International Search Report and Written Opinion prepared by the Korean Intellectual Property Office as International Searching Authority for PCT International Patent Application No. PCT/US2013/023288, mailed May 14, 2013, 9 pages.

Author Unknown, "D.light SolarTM Products." *D.light Design.* 1 page. Last accessed on Aug. 19, 2013. <http://www.dlightdesign.com/productline/>.

Author Unknown, "M-KOPA Solar Products." *M-KOPA KenyaTM.* 2 pages. Last accessed on Aug. 19, 2013. <http://www.m-kopa.com/products/>.

Author Unknown, "Switching on to solar—goodbye kerosene." WIPOMAGAZINE. Sep. 2011. 4 pages. Last accessed on Aug. 19, 2013. http://www.wipo.int/wipo_magazine/en/2011/05/article_0002.html.

Office Action issued Feb. 28, 2015 from the State Intellectual Property Office of People's Republic of China for App. No. 201380007995.8, 14 pages.

* cited by examiner

ENABLEMENT PERIOD CONTROLLED LIGHTING APPLIANCE

CROSS-REFERENCES TO RELATED APPLICATIONS

This non-provisional application claims priority to U.S. Pat. App. No. 61/594,496, entitled "Enablement Period Controlled Solar Lighting Appliance," filed on Feb. 3, 2012, the entire disclosure of which is hereby incorporated by reference for all purposes.

BACKGROUND

Solar-powered energy is versatile: it may be used on a large scale to power solar photovoltaic power stations with megawatts of capacity and on a small scale for applications such as solar-powered rechargeable flashlights. Photovoltaic charging allows for charging when access to sunlight is available (e.g., outside during the day). The charge may be stored using one or more batteries until light is needed, such as at night.

SUMMARY

In some embodiments, a rechargeable lighting appliance is presented. The appliance (or system) may include a light. The appliance may include a rechargeable battery connected with the light. The appliance may include a communication interface configured to receive an enablement period. The appliance may include a non-transitory machine-readable storage device configured to store an indication of the enablement period. The appliance may include one or more processors. The one or more processors may be configured to control a mode of the rechargeable lighting appliance. The mode may be configured to be set to a first mode or a second mode. The first mode may permit illumination of the light at least partially based on activation of the enablement period stored by the non-transitory machine-readable storage device. The second mode may allow for unlimited illumination of the light without activation of the enablement period.

Embodiments of such a rechargeable lighting appliance may include one or more of the following: The light, when illuminated, may have a brightness of at least 20 lumens. When the rechargeable lighting appliance is in the first mode activation of the enablement period stored by the non-transitory machine-readable storage device may permit use of the light for a predefined period of time. Use of the light may not be permitted unless the enablement period is activated. The appliance may include an external device charging connection. When the rechargeable lighting appliance is in the first mode, activation of the enablement period stored by the non-transitory machine-readable storage device may permit use of the external device charging connection for a predefined period of time. Use of the external device charging connection may not be permitted unless the enablement period is activated.

Additionally or alternatively, embodiments of such a rechargeable lighting appliance may include one or more of the following: The rechargeable lighting appliance may include a short-range transceiver. The short-range transceiver may be configured to permit the enablement period to be transferred from the rechargeable lighting appliance to a second rechargeable lighting appliance. The communication interface may include the short-range transceiver. The short-range transceiver may be configured to transfer of the enablement period stored by the non-transitory machine-readable storage device is permitted if the enablement period has not been activated by the rechargeable lighting appliance. Following transfer from the rechargeable lighting appliance to the second rechargeable lighting appliance, the one or more processors may be configured such that: the enablement period is not available for activation by the rechargeable lighting appliance; and the enablement period is available for activation by the second rechargeable lighting appliance.

Additionally or alternatively, embodiments of such a rechargeable lighting appliance may include one or more of the following: The communication interface may be configured to receive the enablement period as an encrypted enablement period. The one or more processors may be further configured to: prior to receiving the encrypted enablement period, provide a random number to a mobile device that is to provide the encrypted enablement period; and after receiving the encrypted enablement period via the communication interface, decrypt the encrypted enablement period us the random number and an encryption key stored locally by the rechargeable lighting appliance. The encrypted enablement period may be encrypted using the random number. The encryption key may not be transmitted between the mobile device and the rechargeable lighting appliance. The rechargeable lighting appliance may include a short-range transceiver, configured to receive the enablement period to be received from a mobile device. The communication interface may include the short-range transceiver. The one or more processors may be further configured such that the enablement period is available for activation by the rechargeable lighting appliance following receipt of the enablement period from the mobile device. The mobile device may be a cellular telephone. At manufacture, a plurality of enablement keys may be stored to the non-transitory machine readable storage device, wherein the plurality of enablement keys are unique from enablement keys of other rechargeable lighting appliances. The one or more processors may be further configured to permit activation of the enablement period only if the enablement period indicates an enablement key of the plurality of enablement keys.

Additionally or alternatively, embodiments of such a rechargeable lighting appliance may include one or more of the following: The one or more processors may be further configured to: enter the second mode from the first mode after a threshold number of enablement periods have been activated on the rechargeable lighting appliance; and once the second mode is entered based on the threshold number of activations of enablement periods being met, the rechargeable lighting appliance remains permanently in the second mode. The non-transitory machine-readable storage device may be further configured to store a total number of enablement periods activated on the rechargeable lighting appliance. The rechargeable lighting appliance may include an accelerometer, in communication with the one or more processors, wherein the one or more processors are configured, based on data received from the accelerometer, to detect a symbolic actuation action performed using the rechargeable lighting appliance. The symbolic actuation action may represent a physical action analogous to a non-electronically actuated analogue of the rechargeable lighting appliance. The symbolic actuation action may include tipping the rechargeable lighting appliance within communication range of the second rechargeable lighting appliance. The rechargeable battery may be configured to be rechargeable regardless of whether the rechargeable lighting appliance is in the first mode or the second mode. The lighting appliance may include a solar panel configured to recharge the rechargeable battery. The rechargeable lighting appliance may be waterproof.

In some embodiments, a method for controlling use of a rechargeable lighting appliance is presented. The method may include setting the rechargeable lighting appliance to a first mode. The first mode may permit illumination of a light of the rechargeable lighting appliance at least partially based on activation of an enablement period stored by the non-transitory machine-readable storage device. The method may include receiving, by the rechargeable lighting appliance, the enablement period. The method may include storing, by the rechargeable lighting appliance, the enablement period. The method may include receiving, by the rechargeable lighting appliance, user input that indicates to activate the enablement period. The method may include enabling, by the rechargeable lighting appliance, use of the light for a predetermined period of time at least partially based on activation of the enablement period. While in the first mode, the light of the rechargeable lighting appliance may not illuminate continuously for longer than a second predetermined period of time if the enablement period has not been activated.

Embodiments of such a method may include one or more of the following: The method may include enabling, by the rechargeable lighting appliance, use of an external device charging connection for a predetermined period of time at least partially based on activation of the enablement period. The enablement period may be received from a cellular phone via a wireless communication protocol. The method may include following receiving the enablement period, increasing, by the rechargeable lighting appliance, an available enablement period count. The method may include, following activation of the enablement period, decreasing, by the rechargeable lighting appliance, the available enablement period count. The method may include, while in the first mode, tracking, by the rechargeable lighting appliance, an amount of time since the enablement period was activated. The method may include, while in the first mode, disabling, by the rechargeable lighting appliance, following expiration of the predetermined period of time, availability of the light for continuous illumination longer than the second predetermined period of time. The method may include, following enabling use of the light for the predetermined period of time at least partially based on the activation of the enablement period, increasing, by the rechargeable lighting appliance, a lifetime activated enablement period count.

Embodiments of such a method may additionally or alternatively include one or more of the following: The method may include receiving, by the rechargeable lighting appliance, a second enablement period. The method may include storing, by the rechargeable lighting appliance, the second enablement period. The method may include receiving, by the rechargeable lighting appliance, user input that indicates to activate the second enablement period. The method may include entering, by the rechargeable lighting appliance, a second mode based on the lifetime activated enablement period count reaching a predetermined lifetime activated enablement period count threshold in response to activation of the second enablement period. The second mode may permit continuous illumination of the light without activation of enablement periods. The method may include receiving, by the rechargeable lighting appliance, a second enablement period. The method may include receiving, by the rechargeable lighting appliance, user input that indicates to transfer the second enablement period to a second rechargeable lighting appliance. The method may include transferring, by the rechargeable lighting appliance, the second enablement period to the second rechargeable lighting appliance. The method may include following the transfer, the second enablement period is not available for activation by the rechargeable lighting appliance. The method may include following the transfer, the second enablement period is available for activation by the second rechargeable lighting appliance.

In some embodiments, a lighting appliance is presented. The lighting appliance may include means for lighting. The lighting appliance may include means for setting the lighting apparatus to a first mode. The first mode may permit illumination of the means for lighting at least partially based on activation of an enablement period. The lighting appliance may include means for receiving the first enablement period. The lighting appliance may include means for storing the first enablement period. The lighting appliance may include means for receiving user input that indicates to activate the first enablement period. The lighting appliance may include means for incrementing a lifetime activated enablement period count in response to the first enablement period being activated. The lighting appliance may include means for enabling use of the light for a first predetermined period of time at least partially based on activation of the first enablement period. While in the first mode, the means for lighting may not illuminate continuously for longer than a second predetermined period of time if the first enablement period has not been activated. The lighting appliance may include means for receiving a second enablement period after the first enablement period is received. The lighting appliance may include means for storing the second enablement period. The lighting appliance may include means for receiving user input that indicates to activate the second enablement period. The lighting appliance may include means for incrementing the lifetime activated enablement period count in response to the second enablement period being activated. The lighting appliance may include means for entering a second mode based on the lifetime activated enablement period count reaching a predetermined lifetime activated enablement period count threshold in response to activation of the second enablement period. The second mode may permit continuous illumination of the means for lighting without activation of enablement periods.

BRIEF DESCRIPTION OF THE DRAWINGS

A further understanding of embodiments of the invention may be realized by reference to the following figures. In the appended figures, similar components or features may have the same reference label.

DETAILED DESCRIPTION

Figure 1:
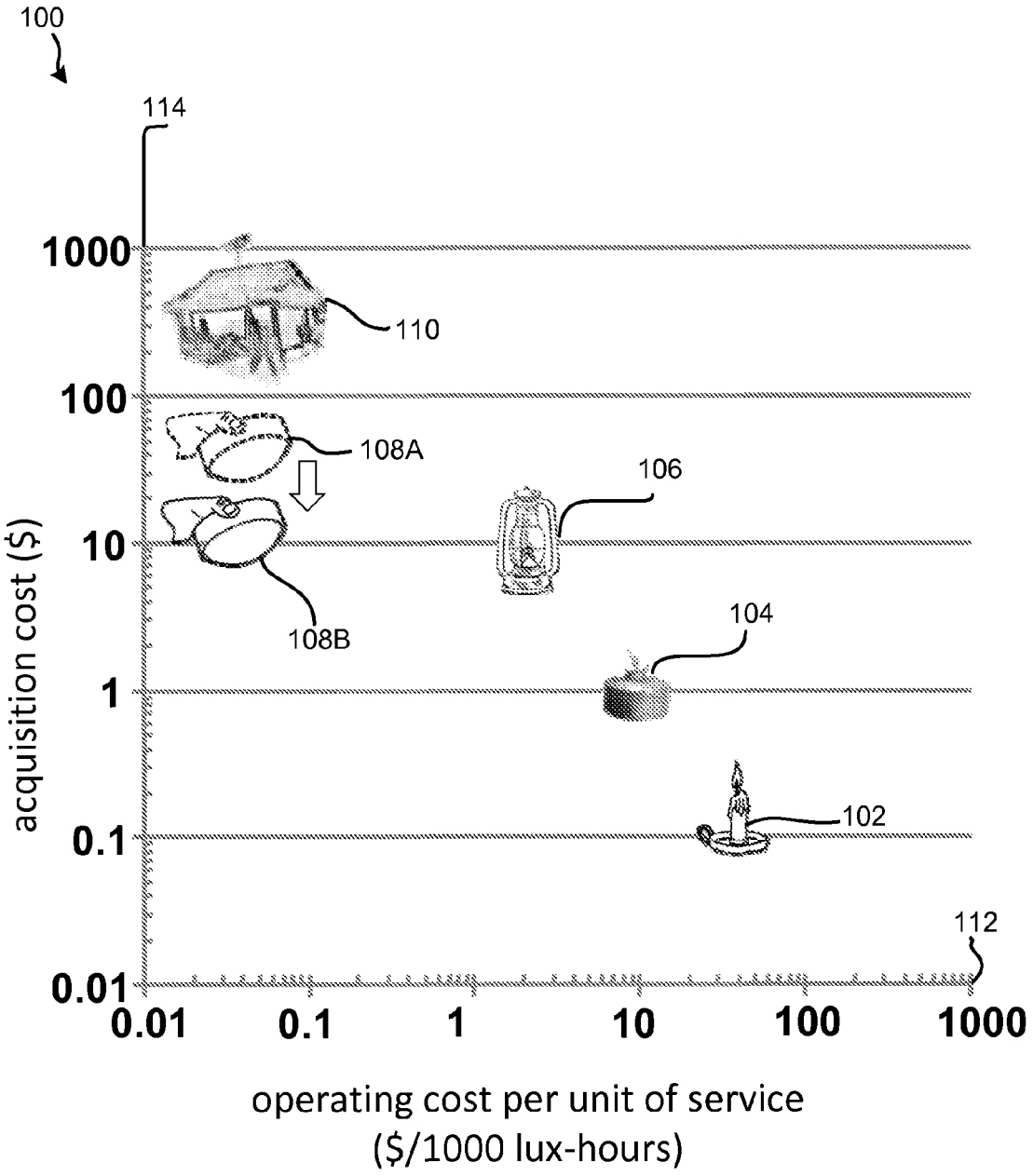
FIG. 1 illustrates an exemplary chart of the relative annual cost per thousand lux-hours of various types of lighting.

"Symbolic actuation action" as used herein is defined as an action performed to actuate one or more functions of an electronically-controlled appliance. A symbolic actuation action may be suggestive of an analogous physical action typically associated with a non-electronically actuated analogue of the electronically-controlled appliance. For example, kerosene from one lamp may be shared by pouring it into another lamp. Similarly, a first candle may be tipped and placed above a second candle with the wicks of both candles in close proximity to light the second candle. A tipping action that mimics such a traditional transfer (e.g., of kerosene or fire) may be mimicked in an electronic context to transfer data, as detailed herein. Mimicking such a physical action to actuate a function to be performed by an electronically-controlled appliance is defined herein as a symbolic actuation action.

An "enablement period" (EP) as used herein is defined as a unit corresponding to a period of time of a predetermined length for which one or more electronic functions of an electronic appliance are enabled for use. Controlling or monitoring of enablement periods may be different from controlling or monitoring usage. During the time corresponding to an enablement period, a user may be permitted use (e.g., unlimited use) of the electronic appliance. Enablement periods may involve a time period during which one or more functions of an appliance are enabled for unlimited use. Enablement periods may be purchased, shared, bartered, borrowed, transferred and/or sold.

Solar-powered electronic appliances (which include appliances configured to have batteries charged by a detachable solar-charging device and solar-powered appliances having built-in solar cells) may be useful in situations such as where access to a reliable grid-based electricity source is not available. A solar-powered appliance, such as a solar-powered lighting appliance, may be charged for a period of time using sunlight. The charge may be stored until discharge. As an example, a solar-powered lighting appliance may be charged using sunlight during the day and may be used for light at night. While charging of the solar-powered appliance is free, the solar-powered appliance may cost a significant amount of money to manufacture and/or acquire. As an example, a solar-powered lighting appliance may represent an effective way to generate light in regions of Africa where access to an electrical grid is unavailable or costly. Further, by way of example only, the solar-powered lighting appliance may represent a significant portion of a person's monthly income in such regions of Africa. Further, such regions may also suffer from limited banking systems, thus limiting the ability to enforce purchases made on a credit or installment basis.

Rather than requiring a person to pay the full price of a solar-powered appliance up front, use of the solar-powered appliance may be controlled through the use of enablement periods. As such, despite a user possessing a solar-powered appliance and the solar-powered appliance being charged using sunlight, the ability to use the solar-powered appliance may be controlled using enablement periods. When an enablement period is activated, the solar-powered appliance may be used an unlimited amount during the predefined time period of the enablement period. Once the enablement period expires, another enablement period may be activated (to allow for continued use of the solar-powered appliance) or the solar-powered appliance may be fully or partially deactivated. From a merchant's point-of-view, purchase of enablement periods may serve as an installment payment on the solar-powered appliance. After a certain number of enablement periods have been activated on a solar-powered appliance, the solar-powered appliance may enter an unlimited use mode. In such a mode, enablement periods may no longer control when the solar-powered appliance is enabled for use. Rather, in the unlimited use mode, a user may use the solar-powered appliance an unlimited amount.

Solar-powered appliances, such as solar-powered lighting appliances, that use enablement periods (EPs) may permit unactivated EPs to be transferred to, from, and between solar-powered appliances. For example, if a first solar-powered appliance has one or more stored EPs that have not been activated, one or more EPs may be transferred from the first solar-powered appliance to a second solar-powered appliance. This second solar-powered appliance may be owned by the user, by a neighbor, or some other person. As such, the user may be selling, trading, bartering, gifting, or otherwise transferring the EP to the owner of the second solar-powered appliance. As an example, a user of the first solar-powered appliance may purchase the EP for a first price at a first location (e.g., at a market in a major town) and may resell the EP to a user of a second solar-powered appliance for a second (possibly greater) price at a second location (e.g., a village located a distance from the major town). This EP may be transferred from the first solar-powered appliance to the second solar-powered appliance with payment being handled between the two users.

Since the users of solar-powered appliances may be unaccustomed to working with electronic devices, control of the transfer of EPs between solar-powered appliances may be made to mimic tasks that the users may already perform. For example, a user in an un-electrified village may be accustomed to sharing kerosene by pouring some from his lamp into another person's lamp. A solar-powered appliance may use a symbolic actuation action to mimic such a pouring motion to transfer an EP from a first solar-powered appliance to a second solar-powered appliance. In the instance of solar-powered lighting appliances, two solar-powered lights may be moved into the vicinity of each other (e.g., close enough for a wireless short range communication protocol, such as Bluetooth®, to be used). The solar-powered lighting appliance containing the EP to be transferred may be tipped to a side to mimic the pouring of kerosene (or the transfer of a flame) to the solar-powered lighting appliance that is to receive the EP. As such, by performing a motion similar to what the user already knows, transfer of an EP may be performed between solar-powered appliances.

FIG. 1 illustrates a chart 100 of a comparison between relative annual operating costs per unit of service, shown along the x-axis 112 in logarithmic scale and acquisition cost shown along the y-axis 114, also in logarithmic scale. It should be understood that chart 100 is an exemplary comparison of various embodiments with other types of lighting and does not limit the scope the invention. On chart 100, operating cost per unit of service is measured in dollars per thousand lux-hours. The lux is the standard international (SI) unit of luminance which is the luminous flux (typically measured in lumens) per unit area. Acquisition costs, shown along the y-axis 114, are measured in dollars.

Candle 102, represents a type of lighting commonly used by persons living in very low income areas possibly due relatively low acquisition cost (e.g., less than one dollar) and does not require electricity. However, candle 102 may typically have a relatively high operating cost per unit of service (e.g., around 36 dollars per thousand lux-hours). Kerosene lamp 104, which may also be commonly used in very low income regions and does not require electricity, may have a higher acquisition cost (e.g., around one dollar), but may have a lower operating cost per unit of service (e.g., around five or six dollars per thousand lux-hours, subject to fluctuations in the price of kerosene). A hurricane kerosene lamp 106 may provide more efficient lighting and, although the acquisition cost (e.g., about ten dollars) is considerably higher than kerosene lamp 104, the operating cost per unit of service might be lower (e.g., about three dollars per thousand lux-hours). Roof-top solar-recharged lighting solutions 110 may charge using solar radiation and may have a low operating cost per unit of service (less than one dollar per thousand lux-hours). However the acquisition cost may be relatively high (e.g., around 400 dollars without amortization). Even with amortization the acquisition cost would be substantial and, if the amortized payment were set to provide an acquisition cost in the 15 to 20 dollar range, the duration of the repayment period may be considerable as may the financing costs, assuming financing is available.

Embodiments detailed herein, such as a rugged, high-quality, portable, solar-charged light with efficient optics (which may be referred to as a solar-powered lighting appliance) may have a very low operating cost per unit of service (e.g., around 0.03 dollars per thousand lux-hours). The acquisition cost 108A for such a solar-recharged system, including the solar panel, cables, solar light appliance, and everything needed to operate the system, may be significant (e.g., around 50 or 60 dollars). However, this cost may be amortized using enablement periods to result in an effectively lower acquisition cost 108B (e.g., around 5 to 10 dollars in some markets, or around 15 to 20 dollars in other markets).

Embodiments of the invention may include a rugged, high-quality, portable solar-recharged battery-powered appliance, such as an LED solar-powered lighting appliance and a flexible enablement period method whereby a person may acquire a solar-powered lighting appliance for an acquisition cost that is a fraction of the cost of an outright purchase.

Figure 2:
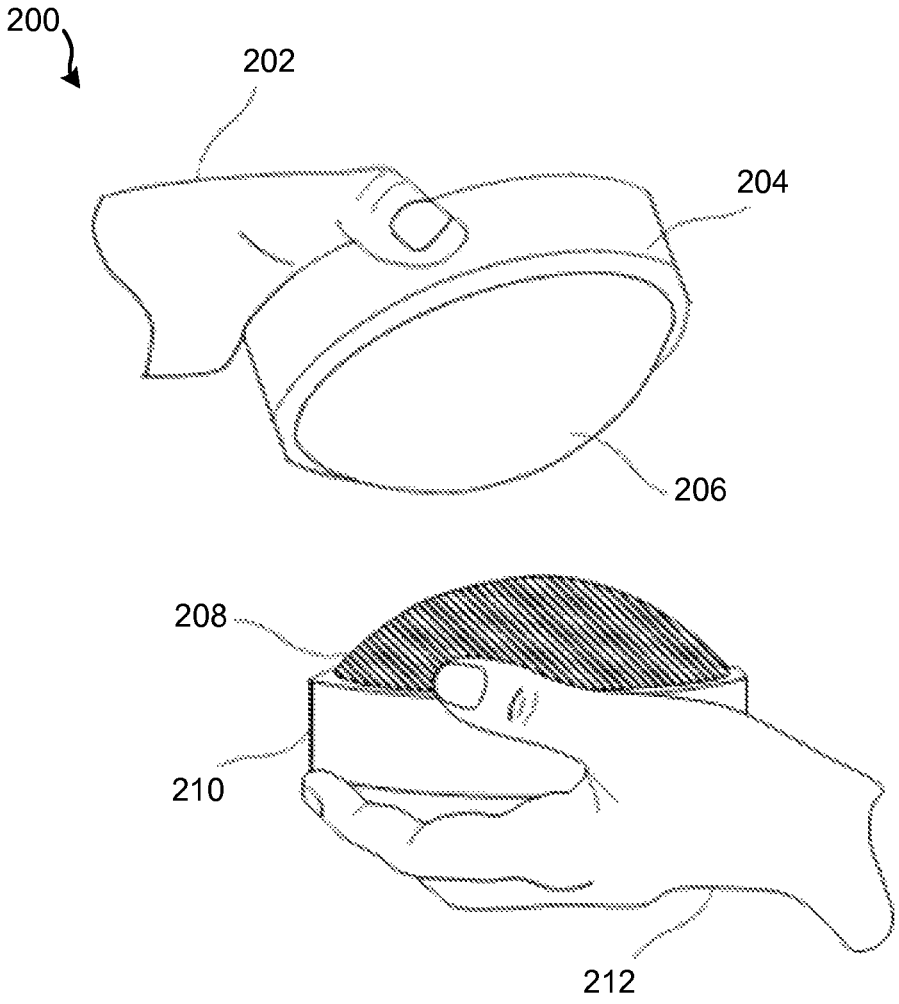
FIG. 2 illustrates an embodiment of two solar-powered lighting appliances communicating.

FIG. 2 is an embodiment of a system 200 that includes two solar-powered lighting appliances communicating. FIG. 2 illustrates a first person 212 holding a solar-powered lighting appliance 210 in his hand. Solar-powered lighting appliance 210 is depicted as being in an unilluminated or "off" state 208. The reason solar-powered lighting appliance 210 is off may be because it has no active enablement period available for use in order to permit the light to turn on. A second person 202 is depicted as performing a symbolic actuation action that initiates the sharing or transferring of one or more EPs. In some embodiments, symbolic actuation actions are used to cause certain functions to be performed. In the illustrated embodiment, there is a symbolic "pouring" of the source of light from solar-powered lighting appliance 204 (which has one or more unactivated enablement periods available for transfer) to solar-powered lighting appliance 210 in order to provide solar-powered lighting appliance 210 with one or more EPs. Solar-powered lighting appliance 204 is depicted as being in an illuminated or "on" state 206. The reason solar-powered lighting appliance 204 is on may be because it has an activated enablement period thus permitting the light to be turned on during a predefined period of time.

Figure 3:
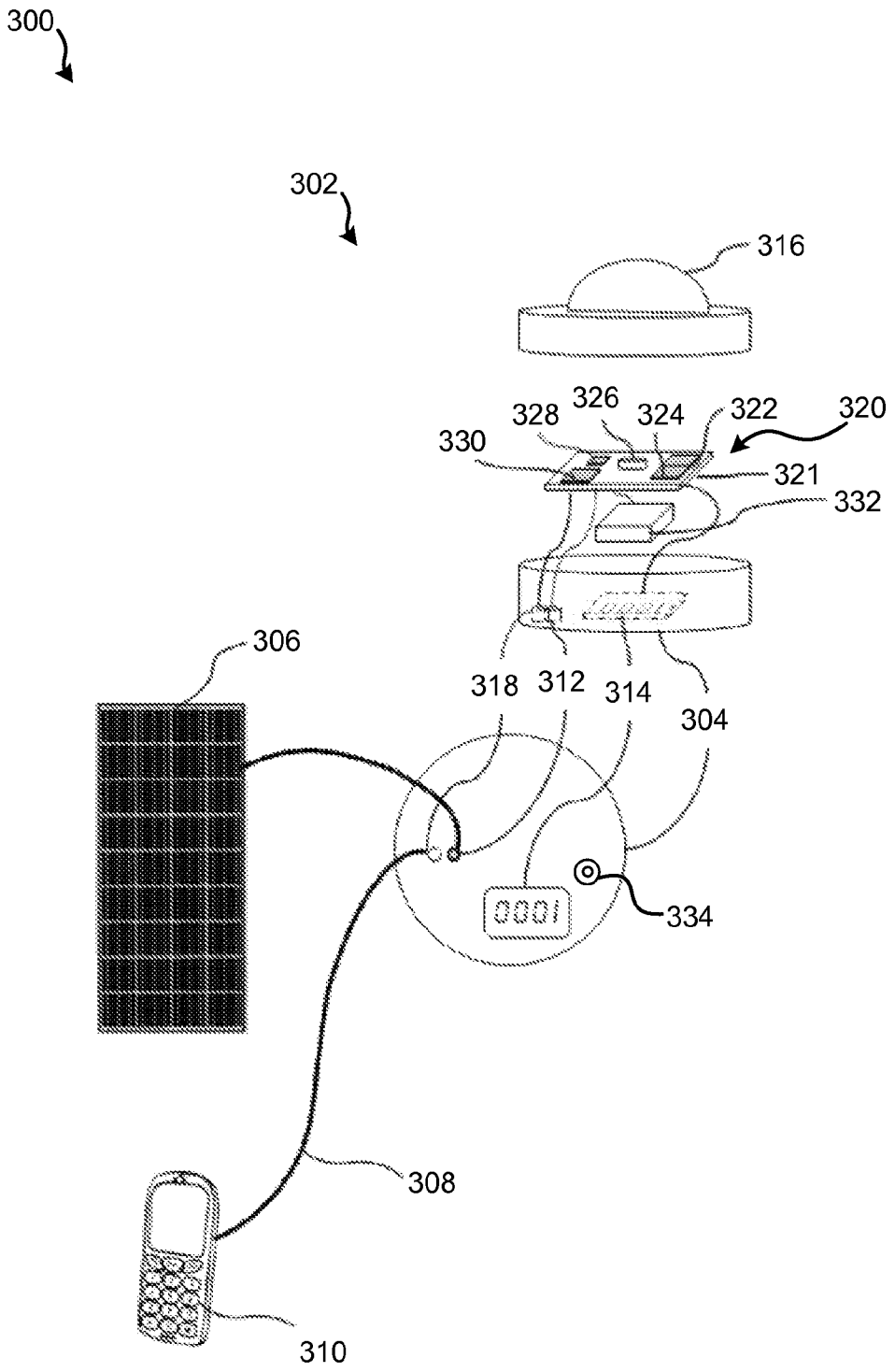
FIG. 3 illustrates an embodiment of a solar-powered lighting appliance.

A symbolic actuation action may be performed to initiate transfer of enablement periods from solar-powered lighting appliance 204 to solar-powered lighting appliance 210. The actual transfer of information between solar-powered lighting appliances may be accomplished, for example, using a local wireless data transfer protocol (e.g., Bluetooth®, low-power Bluetooth®, WiFi Direct®) controlled by a controller present in each solar-powered lighting appliance. At least some of the data transmitted between solar-powered lighting appliances may be encrypted or otherwise protected. In FIG. 3, first person 212 and second person 202 may be the same person. As such, a single person may transfer one or more EPs between solar-powered lighting appliances. For reasons such as to save power and/or prevent accidental transfer of an EP to an incorrect solar-powered appliance, it may be necessary to activate use of the local wireless data transfer protocol, such as by pushing a button on each solar-powered lighting appliance. Once the button has been pushed, the local wireless data transfer protocol may be available for use and one or more symbolic actuation actions may be used to initiate transfer of one or more unactivated EPs between solar-powered lighting appliances.

FIG. 3 illustrates an embodiment of a solar-powered lighting appliance system 300 comprising a solar-powered lighting appliance 302. Solar-powered lighting appliance system 300 may include one or more solar panels, such as a solar panel 306 (e.g., a photovoltaic solar panel) for charging solar-powered lighting appliance 302 that may be connected to a solar charging input 312, which may be included in solar-powered lighting appliance 302. In some embodiments, a plurality of solar panels 306 may be configured together to charge a plurality of solar-powered lighting appliances 302, for example to provide increasing lighting within a single dwelling or within multiple areas of a dwelling. Solar-powered lighting appliance system 300 may further comprise external device connection 318 that may be used to connect via external charging cable 308 to external device 310 (e.g. a cell phone or some other type rechargeable device) in order to recharge external device 310. In some embodiments, external device 310 may be a second solar-powered lighting appliance rather than a cell phone.

Being able to recharge a second solar-powered lighting appliance (which would be the external device 310) by connecting it to the external device connection 318 of solar-powered lighting appliance 302 may be advantageous in that someone wanting to operate an external second solar-powered lighting appliance that has not been charged by a solar panel may do so. For example, someone purchasing a new solar-powered lighting appliance which has not yet been charged via a solar panel may want to operate the new solar-powered lighting appliance for purposes of receiving purchased EPs. Some embodiments are configured such that after purchasing a predetermined number of EPs, the appliance becomes permanently enabled (such as by entering a second, unlimited use mode). Once permanently enabled, solar-powered lighting appliance 302 may be considered "paid off" and may be operated any time (assuming power is available) without additional EPs. A user of a permanently enabled solar-powered lighting appliance may still load EPs to solar-powered lighting appliance 302 to share and/or sell to others. An example of a situation where a user of a permanently enabled solar-powered lighting appliance may desire to purchase more EPs is to resell to acquaintances. The owner may purchase additional EPs and resell (possibly at a higher price) to other persons, such as in a remote location (e.g., a remote village).

Temporary inability to purchase enablement periods (e.g., due to income being sporadic or irregular) may not lead to repossession (e.g., by the merchant) of the solar-powered lighting appliance. The number of enablement periods purchased may be decided upon by the solar-powered lighting appliance user. For example, a user who wants to buy only one enablement period may do so. This enablement period may remain stored by the solar-powered lighting appliance 302 until: 1) the user (or someone else) activates the enablement period on the solar-powered lighting appliance, thus beginning the period of time of the EP (which is a predefined length of time) during which unlimited use of solar-powered lighting appliance 302 is permitted; or 2) the EP is transferred to another solar-powered lighting appliance, such as by performing a symbolic actuation action that initiates a wireless transfer of the EP to the second solar-powered lighting appliance. An enablement period may be predefined as a day (e.g., 24 hours) in some embodiments, a week (seven days) in other embodiments, or a month (30 days) in further embodiments. Other time periods for enablement periods are also possible. The length of time of an EP may be predefined, such that the user of solar-powered lighting appliance 302 is aware of the length of time an EP lasts once activated. Charging of an external device 310, such as a cell phone, may be enabled only when an enablement period is activated (and/or once the solar-powered lighting appliance 302 is permanently enabled). Such behavior may encourage solar-powered lighting appliance users to purchase the required number of EPs to enter the unlimited mode (which may also accelerate the payoff to the merchant that sold the solar-powered lighting appliance 302). In some embodiments, it may be desirable to display in units of a local currency e.g. Namibian dollars or Kenyan Shillings, the payment amount remaining to complete payoff and begin to operate the appliance in unlimited mode.

Embodiments of solar-powered lighting appliance 302 may comprise a base 304 adapted to enclose one or more rechargeable batteries, such as rechargeable battery 332, which may be connected to a controller 320. The controller 320 may comprise a circuit board 321 and a light source 326 controlled by a processor 324 (e.g., a microcontroller). Light source 326 may include one or more lighting elements, such as light-emitting diodes LEDs. Light source 326 may output light sufficient to light an area, such as for reading. Light source 326 may output 20 lumens of light. In some embodiments, light source 326 can be set to different light output levels, such as 20 lumens, 45 lumens, or 110 lumens. It should be understood that other various levels of brightness may be output by light source 326, such as 5 lumens, 10 lumens, 15 lumens, 25 lumens or greater. Other values are also possible.

A non-transitory computer-readable storage medium may be present, such as on or connected with controller 320. The storage medium may be part of processor 324. The processor 324 may be communicatively coupled with a wireless transceiver module 322. Wireless transceiver module 322 may transmit and/or receive data in accordance with a wireless standard, such as Bluetooth® Low Energy (BLE) which is a feature of Bluetooth® 4.0 wireless radio communications standard aimed at low power applications for battery powered devices. Solar-powered lighting appliance 302 may comprise a power control device 328 adapted to control/condition power flowing in to/out of solar-powered lighting appliance 302.

In order to facilitate frequent charging (e.g., daily charging) and daily operation of both the lighting function and/or the cell phone recharging function, the rechargeable battery 332 of solar-powered lighting appliance 302 may be a high-performance rechargeable battery (e.g., a high-performance NIMH or LiFePO4 battery). Some embodiments enable a fully solar-recharged battery to provide 10 to 20 hours of low-level light depending on whether mobile charging is also performed on the same charge. LiFePO4 batteries may have better thermal and chemical stability which may increase safety compared with other lithium ion battery chemistries.

In some embodiments, solar-powered lighting appliance 302 may further comprise a symbolic actuation detection device 330 that acts as a user interface input that detects or responds to a symbolic actuation action. Symbolic actuation detection device 330 may be in communication with processor 324. For example, symbolic actuation detection device 330 may comprise a microelectromechanical system (MEMS) which functions as an accelerometer or a motion/position detector. Other types of accelerometers may also be present. For example, in various embodiments the symbolic actuation detection device 330 may detect a "pouring action," a "shaking action," or a "tipping action." The symbolic actuation actions may add to the enjoyment of using the solar-powered lighting appliance as a means of sharing or transferring enablement periods from one solar-powered lighting appliance to another solar-powered lighting appliance. Furthermore, in very low income regions, there may be an awareness of technology and a higher status symbol value associated with owning interesting and novel technology products than in old or commonplace products such as kerosene lamps.

Embodiments may comprise symbolic confirmation events which are performed by the solar-powered lighting appliance to symbolically communicate the status of the appliance. In some embodiments, a component of the solar-powered lighting appliance may have a normal operational mode and a symbolic confirmation mode. For example, some embodiments of a solar-powered lighting appliance may utilize the LED light source in a normal operation mode to provide light based on the user pushing or sliding a mechanical switch to move between on and off modes. Pushing or sliding a mechanical switch may not be considered a symbolic actuation action because pushing or sliding a switch would normally be associated with actuating an electrical or electronic appliance but would not normally be associated with lighting candles or transferring fuel from one kerosene lamp to another. Therefore, for normal operational modes it would be intuitive for the user to utilize non-symbolic traditional actuation actions and to get the expected non-symbolic response. For example, a user may push the button once for low light, twice for medium intensity light, and three times for high intensity light.

In an embodiment of FIG. 3, symbolic actuation detection device 330 is illustrated by way of example as being an integrated circuit mounted on circuit board 321. However, any type of solar-powered appliance may be constructed with one or more symbolic actuation detection devices 330, 334 connected to controller 320. As one example, symbolic actuation detection device 334 may be a microphone that detects a blowing action symbolically representing blowing on a candle, which may symbolically represent fanning a flame, or alternatively blowing out a candle. As another example, symbolic actuation detection device 334 may be any desired type of sensor such as a magnetic field sensor that detects presence of a magnet and thereby can detect presence, absence or movement of a device with a magnet which may symbolically represent striking a spark. In an additional example, symbolic actuation detection device 334 may be a capacitive sensor that detects the presence, absence, or movement of an object such as a human hand via capacitance. Such a sensor may detect symbolic actuations such as a person rubbing a "magic lamp," In a further example, symbolic actuation detection device 334 may be a light sensor or an infrared (i.e. heat) sensor that may detect the symbolic action of bringing a first lamp that is lit close to a second lamp that is unlit to cause the second lamp to light. Symbolic actuation detection device 330 may be used in combination with symbolic actuation detection device(s) 334 to detect multiple types of symbolic actuation actions simultaneously or sequentially.

In some embodiments of the invention, symbolic actuation actions may lead to a symbolic confirmation event. For example, when an enablement period (EP) is transferred from a first solar-powered lighting appliance to a second solar-powered lighting appliance, the sending lamp may remain on while the receiving lamp blinks every three seconds, symbolically suggestive of a "drop of light flowing" from the first solar-powered lighting appliance to the second solar-powered lighting appliance every three seconds. For convenience, in addition to the symbolic confirmation event, display 314 may track the number of unactivated enablement periods stored by solar-powered lighting appliance 302. Display 314 may additionally or alternatively indicate a remaining number of enablement periods required to be activated on the solar-powered lighting appliance 302 until the unlimited use mode is entered. As such, display 314 may indicate: 1) a number of EPs currently available for activation by the solar-powered lighting appliance (available for use and/or transfer); and 2) a number of EPs required to be activated on the solar-powered lighting appliance until an unlimited use mode is realized. In some embodiments, separate electronic status displays may be present for each of these tallies. Data for such numbers may be stored by a non-transitory machine-readable medium of the solar-powered lighting appliance.

Many customers living in rural low income regions value rugged, substantially waterproof products. Therefore, embodiments of solar-powered lighting appliance 302 may be adapted to be substantially weatherproof or substantially waterproof, such as by sealing the interface between the base 304 (which may be a waterproof polymeric base) and waterproof optical diffusion lens 316 utilizing sealing mechanisms such as o-rings, gaskets, and the like. Any external connections present, such as external device connection 318, may also be waterproof and/or weatherproof. While the above description focuses on solar-powered lighting appliances, it should be understood that similar features may be present in rechargeable lighting appliances generally or other forms of rechargeable appliances, such as a solar-powered radio.

The embodiment of solar-powered lighting appliance system 300 is exemplary; other embodiments may be arranged differently. In some embodiments, solar panel 306 may be incorporated into solar-powered lighting appliance 302. Solar panel 306 may or may not be removable. Further, in some embodiments, a button, or other user input device, may be present that enables wireless communication and/or symbolic actuation action detection. As such, when not activated, such components, such as symbolic actuation detection device 330 and wireless transceiver module 322 may be disabled (e.g., to save power and/or prevent accidental transfer of EPs).

Figure 4:
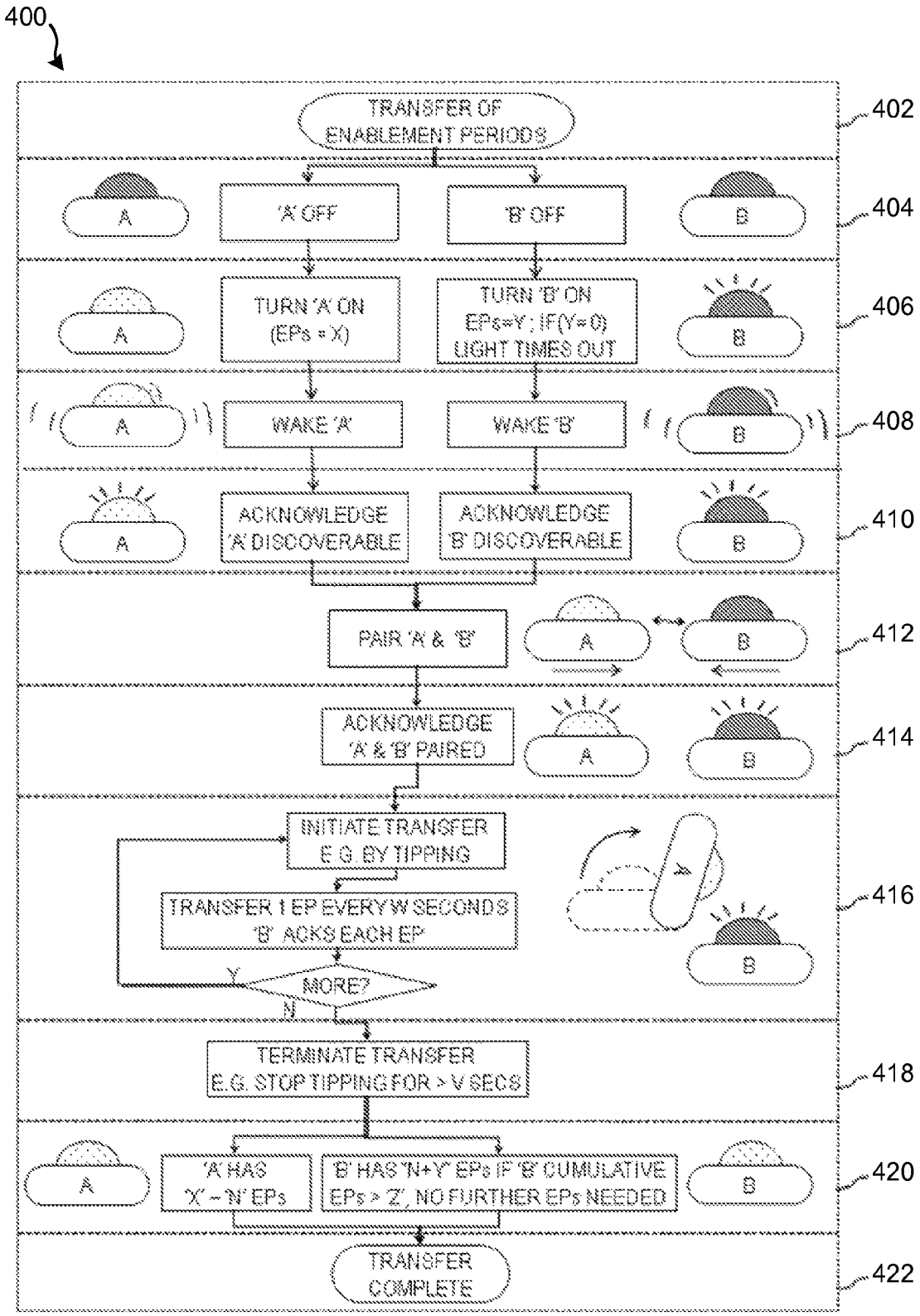
FIG. 4 illustrates an embodiment of a method for symbolic actuation action-initiated wireless transfer of enablement periods.

FIG. 4 illustrates an embodiment of a method 400 for symbolic actuation action-initiated wireless transfer of enablement periods (EPs). The solar-powered lighting appliances used in method 400 may represent embodiment of solar-powered lighting appliance 302 of FIG. 3. Method 400 may also be performed with other embodiments of solar-powered lighting appliances. Means for performing the steps of method 400 include one or multiple instances of components of solar-powered lighting appliance system 300, one or more processors, and/or one or more non-transitory storage mediums.

An exemplary transfer of an enablement period is illustrated as beginning at step 402 from solar-powered lighting appliance "A" to solar-powered lighting appliance "B". Each of the solar-powered lighting appliances may function in two modes: a first mode in which an enablement period is required to be activated for the light to be continuously lit for greater than a predefined period of time; and a second mode (an unlimited use mode) that does not require EPs for the light to be continuously lit for greater than a predefined period of time. Solar-powered lighting appliances may initially be in the first mode and may switch to the second mode after a predefined number of enablement periods have been activated by the solar-powered lighting appliance. At the beginning of method 400, both solar-powered lighting appliances are in the first mode. As such, for the light to be continuously illuminated (e.g., to allow it to be functionally useful, such as for use as a reading lamp) an enablement period may need to be activated. When activated, the enablement period may permit continuous illumination of the light for a predefined period of time, such as a day. During this time, the only constraint on use may be the available charge of one or more batteries of the solar-powered lighting appliance which are charged using a solar panel.

In some embodiments, when a solar-powered lighting appliance is in the first mode, but an enablement period has not been activated, the light may be prevented from turning on, or may only be permitted to turn on for a short duration (e.g., a second period of time, such as 1 second). Allowing the light to turn on for such a short duration may permit the user to confirm that the light is functional and/or charged. However, such a short duration may make the light un-useful for other tasks besides confirming functionality and/or battery charge. Turning on briefly when out of enablement periods may enable a user to distinguish between a solar-powered lighting appliance that is out of EPs and a solar-powered lighting appliance wherein the battery is discharged. In other words, if the user pushes the button to turn the solar-powered lighting appliance on and sees no light from the solar-powered lighting appliance, the user can determine that the solar-powered lighting appliance battery needs charging. In contrast, if the solar-powered lighting appliance turns on briefly and then turns off after a short timeout period, the user can surmise that the appliance battery is at least partially charged, but the solar-powered lighting appliance is out of EPs. In some embodiments, display 314, as shown in FIG. 3 may indicate that EPs need to be added before solar-powered lighting appliance A can be operated to provide light or to charge a device such as a cell phone. Display 314 may also be configured to show the battery charge level, estimated time remaining based on battery charge level, time left for an activated EP, and/or any desired parameter relating to battery charge level or EP status. Since the level of power typically required to activate a low power display, e.g. an LCD display, is usually low in comparison to the level of power required to operate the main illumination LED(s), direct display of battery level and EP status or both may be a desirable way to determine whether EPs need to be purchased, whether the battery needs to be charged, or both. Even in a situation where a battery charge has been depleted to a level too low to operate the display, connecting the appliance to a charging source may enable the display to operate and indicate that charging of the battery is needed. Charging of the solar-powered lighting appliance battery may be permitted whether or not the solar-powered lighting appliance has any EPs. At step 404, solar-powered lighting appliance A is in an off state and is thus depicted as dark (unilluminated) and solar-powered lighting appliance B is also turned off and shown as dark.

At step 406, solar-powered lighting appliance A is turned on, such as by pressing a button. Solar-powered lighting appliance A has x unactivated enablement periods stored, wherein x>0. In the illustrated embodiment of method 400, an enablement period for solar-powered lighting appliance A is already activated; therefore solar-powered lighting appliance A is continuously illuminated at step 406. It may not be necessary for an enablement period to be currently activated on solar-powered lighting appliance A in order for solar-powered lighting appliance A to transfer an unactivated EP. Since solar-powered lighting appliance A also has one or more unactivated EPs, solar-powered lighting appliance A is available to transfer EPs. Solar-powered lighting appliance B is also turned on, such as by pushing a button. Since solar-powered lighting appliance B has zero EPs, solar-powered lighting appliance B may turn on briefly and then time out by going dark again, such as after 1 or 5 seconds.

At step 408, in some embodiments, each of the solar-powered lighting appliances is "awakened" by the user performing an action, for example, shaking the solar-powered lighting appliances. This may be thought of as a symbolic actuation action analogous to shaking a first kerosene lamp to determine how much kerosene it holds before attempting to pour or transfer fuel to a second kerosene lamp. The shaking may be sensed by the symbolic actuation detection device (e.g., accelerometer). In some embodiments, a button is pushed or some other form of user input is provided that causes each solar-powered lighting appliance to search for other solar-powered lighting appliances for communication. The controller in each of the solar-powered lighting appliances receives data from the symbolic actuation detection device and the firmware enters a wireless communication session. Step 408 may be used to enable communication with other devices, such as other solar-powered lighting appliances. Step 408 may permit power to be saved by having wireless communication components of each solar-powered lighting appliance remain powered down when use is not needed.

An acknowledgement may be output at step 410, for example, by flashing the light, that the wireless communication module in each solar-powered lighting appliance is indicated as turned on and that each solar-powered lighting appliance is discoverable for wireless communication. Further, at step 410, solar-powered lighting appliance A and solar-powered lighting appliance B are brought into proximity with each other (if they are not already). Proximity means the solar-powered lighting appliances are close enough such that wireless communication between the solar-powered lighting appliances is possible. Proximity may be defined as close enough to enable the wireless communication link, such as several feet. Proximity may vary by wireless communication protocol. A wireless communication link may be established between the appliances (they become paired) at step 412. Further, in order to limit any accidental transfer of EPs, close proximity may be required, such as two feet. An acknowledgment of successful pairing may be made by one or both solar-powered lighting appliances at step 414, such as by each light flashing a number of times (e.g., once, twice, or some other pre-defined number of flashes).

At step 416, a symbolic actuation action may be performed using solar-powered lighting appliance A. This symbolic actuation action may be representative of a "tipping" or "pouring" action symbolic of "pouring" "oil" from solar-powered lighting appliance A into solar-powered lighting appliance B. Such a tipping or pouring symbolic actuation action is illustrated as part of step 416. An EP may be transferred from solar-powered lighting appliance A to solar-powered lighting appliance B at a predetermined rate, for example, one EP every second or every three seconds or at any predetermined rate. Solar-powered lighting appliance A, the solar-powered lighting appliance "giving" one or more EPs, may continue shining as long as it has EPs remaining. Solar-powered lighting appliance B, the solar-powered lighting appliance receiving one or more EPs, may acknowledge each EP by performing a confirmation action. For example, solar-powered lighting appliance B may flash as each EP is symbolically "poured" from solar-powered lighting appliance A into solar-powered lighting appliance B. The user can continue pouring EPs from solar-powered lighting appliance A to solar-powered lighting appliance B as long as there are EPs available on solar-powered lighting appliance A. If solar-powered lighting appliance A is a "paid off" lamp (that is, in unlimited mode) then the light may remain turned on for solar-powered lighting appliance A when out of EPs. Solar-powered lighting appliance B may stop acknowledging the transfer of EPs from solar-powered lighting appliance A once all of the EPs from solar-powered lighting appliance A have been transferred. A user may conclude a transfer of EPs by no longer tipping (or some other symbolic actuation action) solar-powered lighting appliance A near solar-powered lighting appliance B. Moving the solar-powered lighting appliances apart may also conclude transfer of EPs.

In some embodiments, a display on each solar-powered lighting appliance indicates the number of EPs stored by the solar-powered lighting appliance. Such a display may be seen on the bottom of solar-powered lighting appliance A when it is tipped to perform the symbolic pouring action. If the user of solar-powered lighting appliance A accidentally transfers more than the intended number of EPs into solar-powered lighting appliance B, the transfer can be reversed by transferring (e.g., "pouring") one or more EPs back from solar-powered lighting appliance B to solar-powered lighting appliance A with the symbolic pouring actuation action being performed on solar-powered lighting appliance B and solar-powered lighting appliance A acknowledging. When the desired number of EPs has been transferred between solar-powered lighting appliances A and B, the transfer session may be terminated by performing a symbolic actuation action on solar-powered lighting appliance A, e.g., stop "tipping" or "pouring" at step 418, such as for a period of greater than a predetermined timeout period. Alternatively, a button may be pressed or some other form of user input may be used to disable communication between the solar-powered lighting appliances. Electronic displays on each solar-powered lighting appliance may be updated to indicate the number of unactivated enablement periods now available at each solar-powered lighting appliance.

At step 420, the EPs stored by each solar-powered lighting appliance (which may be indicated on the display of each solar-powered lighting appliance) can be viewed by the users for use in determining that the desired number of EPs have been transferred and the transfer is complete. The transfer of EPs may be complete at step 422. Unactivated EPs present on a solar-powered lighting appliance may not be counted towards the threshold necessary to enter unlimited mode until the EPs are activated and used for lighting (rather than transfer).

In some embodiments, if an EP transfer session has been terminated inadvertently or intentionally, a new session must be started in order to transfer more EPs, for example, the lamps must be shaken again as shown in step 408.

While in method 400 each solar-powered lighting appliance is in a first mode which requires activation of an enablement period for continuous use of the light for a period of time, one or both solar-powered lighting appliances of method 400 may be in a second, unlimited use mode. It may be useful to transfer unactivated enablement periods from a solar-powered lighting appliance that is in the second mode so that the enablement period can be sold, gifted, bartered, or otherwise transferred to a solar-powered lighting appliance that can use the enablement period. Further, a solar-powered lighting appliance in the second, unlimited use mode may receive EPs. An EP may be received by a solar-powered lighting appliance in the second mode such that the EP can again be transferred to a solar-powered lighting appliance that is in the first mode. This may allow an owner of a solar-powered lighting appliance that is in the second mode to still purchase EPs for sale, gifting, or other forms of transfer to other solar-powered lighting appliance.

The steps illustrated in method 400 are exemplary of symbolic actuation actions and symbolic confirmation events appropriate for certain embodiments associated with lighting sources, i.e., the symbolic actions are suggestive of actions traditionally associated with lighting sources not normally electronically actuated such as kerosene lamps or candles. In other embodiments, other symbolic actions and events may be utilized, for example, if the appliance is a radio or a digital music player, the symbolic actuation actions and confirmation events may involve sound. In other embodiments, any number or combination of symbolic actions and non-symbolic actions may be used for actuation and confirmation. While method 400, and the other systems and methods of this document, are generally directed to solar-powered lighting appliances, it should be understood that similar principles may be applied to other forms of solar-powered appliances and/or, more generally, solar-power rechargeable appliances.

Figure 5:
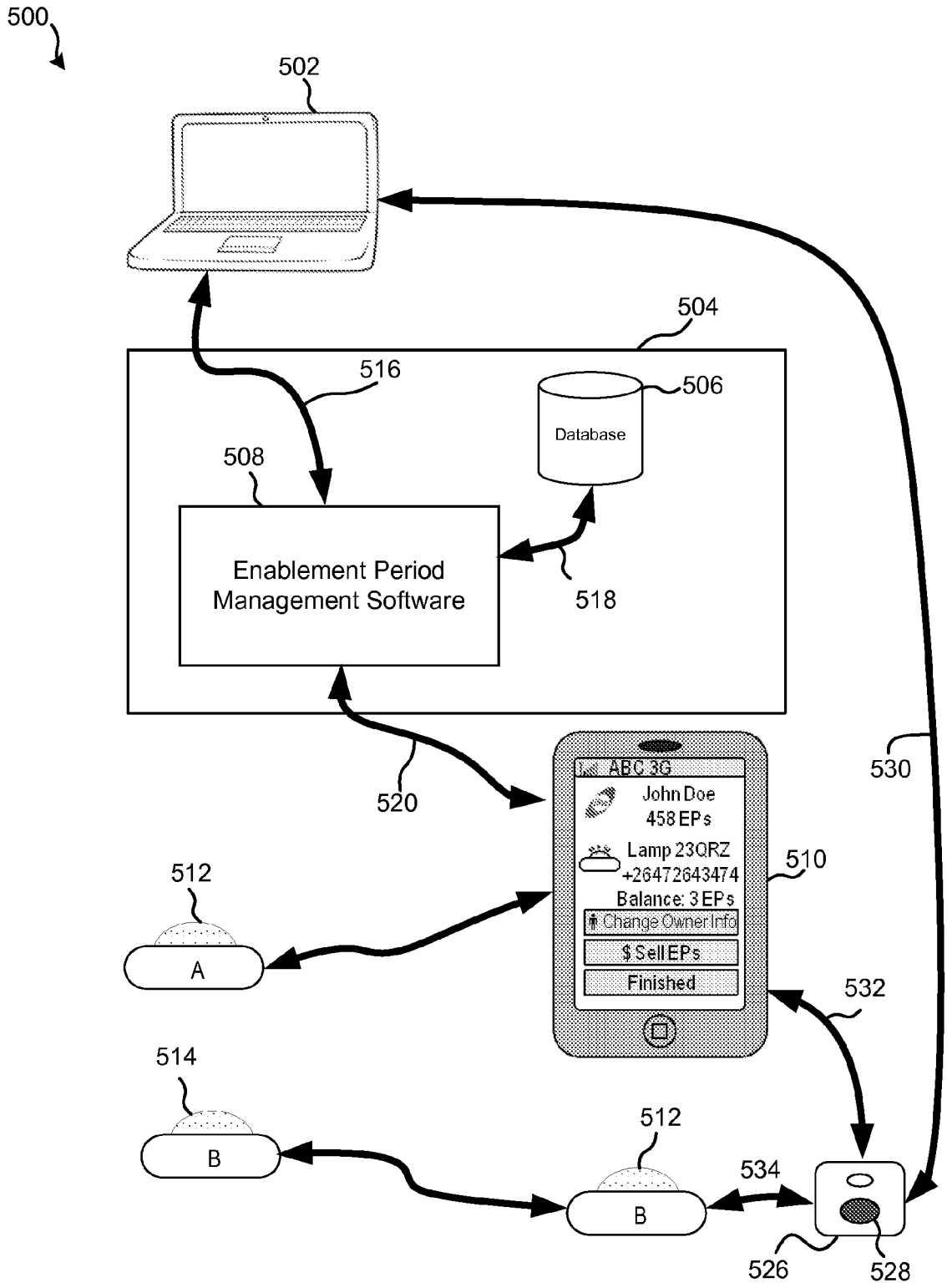
FIG. 5 illustrates an embodiment of a system for managing and distributing enablement periods to solar-powered lighting appliances.

While enablement periods may be transferred from solar-powered lighting appliance to solar-powered lighting appliance, the EPs may need to be initially acquired from a remote server, such as a remote server operated by the distributor or manufacturer of the solar-powered lighting appliances. FIG. 5 is a diagram of an embodiment of an enablement period control system 500. Enablement period control system 500 may comprise: solar-powered lighting appliances 512 and 514, administrator computer system 502, web server 504, and a mobile device 510. Solar-powered lighting appliances 512 and 514 may represent the solar-powered lighting appliance of FIG. 3 or some other embodiment of solar-powered lighting appliance.

In the illustrated embodiment of system 500, a mobile device 510 (which may be a cellular phone) is executing a software application that communicates with a solar-powered lighting appliance 512 and web server 504 that is executing enablement period management software 508 to perform a transfer of one or more EPs from a user account stored on a database 506 located on a non-transitory computer storage device. Machine-to-machine communication between the mobile phone and solar-powered lighting appliance 512 may be via a serial communications protocol over a short-range wireless connection such as Bluetooth® LE or via a wired serial connection using a physical cable. Machine-to-machine communication 520 between the mobile phone and web server 504 may be done using various WAN methods employed in wireless telephony networks such as SMS, WAP, or TCP/IP data communications. Machine-to-machine communication 520 may occur via one or more networks, which may include the Internet.

Administrator computer system 502, which may be a notebook or desktop computer with network (e.g., Internet) access to web server 504, may perform administration and maintenance tasks to enablement period management software 508 by interacting with web server 504 through a web browser-based set of forms and dialogs served to the administrator computer system 502 from web server 504. For instance, an administrator, via administrator computer system 502, may make one or more EPs available to particular user accounts. Therefore, once made available (e.g., after a sale), the one or more EPs may be acquired by mobile device 510 and subsequently transferred to one or more solar-powered lighting appliances.

A mobile device 510 executing a software application may also perform administration and maintenance tasks to enablement period management software 508. It should be understood that mobile device 510 may also be some other form of mobile device, such as a personal digital assistant, tablet computer, etc.

Solar-powered lighting appliance 512 and solar-powered lighting appliance 514, as detailed in relation to FIG. 4, may perform machine-to-machine communication via a serial communications protocol over a short-range wireless connection or via a wired serial connection using a physical cable for the purpose of transferring EPs.

System 500 may allow for a purchase transaction to be conducted between mobile device 510 and web server 504 to purchase one or more EPs. These EPs may be purchased remotely using mobile device 510. As such, communication between mobile device 510 and web server 504 may occur via one or more networks, such as the Internet and/or a cellular communication network. Once purchased, an indication of the one or more EPs may be stored locally by mobile device 510 or may be accessible at the web server 504 via the one or more networks. The EPs purchased using mobile device 510 may be transferred, sold (e.g., at cost, discount, or at a profit), gifted, bartered, or otherwise transferred to owners of solar-powered lighting appliances. While transfer of EPs may occur from mobile device 510 to solar-powered lighting appliances, such as solar-powered lighting appliance 512, payment may occur via a different method for the EP, such as cash, goods, services, IOU, etc. Solar-powered lighting appliance 512 may be used to either 1) activate the EP to enable solar-powered lighting appliance 512 for illumination for a predefined period of time; or 2) transfer to another solar-powered lighting appliance, such as solar-powered lighting appliance 514. This process may continue, and solar-powered lighting appliance 514 may either 1) activate the EP to enable the solar-powered lighting appliance for illumination for a predefined period of time; or 2) transfer the EP to yet another solar-powered lighting appliance.

As such, in an area that has cellular service, it may be possible to use mobile device 510 (which may be a mobile phone) to purchase EPs remotely from web server 504 and then locally (e.g., near-field communication, Bluetooth® LE, WiFi® Direct, a physical cable, etc.) distribute the EPs to one or more solar-powered lighting appliances, such as solar-powered lighting appliance 512. In some embodiments this local distribution of EPs may be performed whether or not cellular service is available at the site and time of the local distribution. A reseller of EPs and/or a solar-powered lighting appliance user may be equipped with mobile device 510 to allow purchase of EPs for himself and/or for customers.

In some areas, it may be convenient to transfer EPs from computer 502 or a mobile device 510 to a simple transfer device 526. The simple transfer device 526 may be small enough to conveniently transport several such devices in a small container, such as a pocket. The simple transfer device may be a device with a simple user interface such as a button 528 which can be used to initiate pairing with a device in order to receive or transmit EPs. To receive EPs from a computer 502, the button 528 may be pushed to initiate or confirm pairing of the simple transfer device 526 with a computer 502 or a mobile device 510 via any communication channel 530 or 532, e.g. Bluetooth® LE, WiFi® Direct, a physical cable, or any desired interface, to receive EPs from the computer 502 via communication channel or mobile device 510 via communication channel 534 or to transmit EPs to the computer 502 via communication channel 530 or the mobile device 510 via communication channel 532. Then, at a convenient location and time, a user may transfer EPs from the simple transfer device 526 via connection 534 to a solar powered appliance such as solar-powered lighting appliance 512. Simple transfer device 526 may be useful because it can be relatively small and convenient to carry. For example, simple transfer device 526 may be in the form of an electronic key fob. Such a key fob may be programmed to receive a desired number of EPs from an EP distributor upon payment. Then the simple transfer device 526, e.g. key fob, may be configured to when the button is pushed, transfer a predetermined number of stored EPs, e.g. 1, 10, or all, to a solar-powered appliance such as a solar-powered lighting appliance, or a larger whole room solar-powered lighting appliance.

Figure 6:
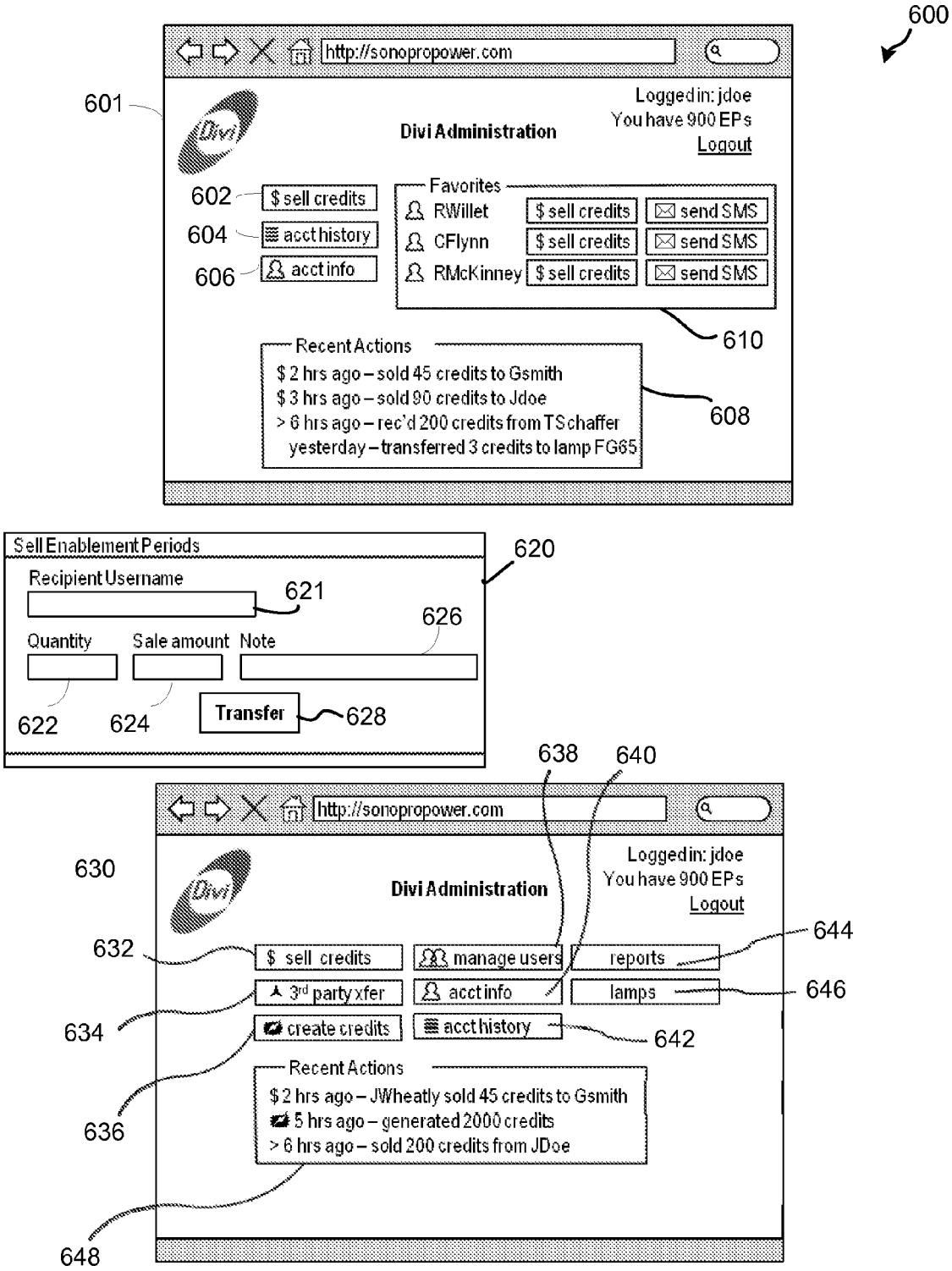
FIG. 6 illustrates screen shots of embodiments of an administration controller for generating, selling, and distributing enablement periods for solar-powered lighting appliances.

FIG. 6 illustrates screen shots of an embodiment of an administration controller 600 for generating, selling, and distributing enablement periods for solar-powered lighting appliances. Administration controller 600 may be performed using the administrator computer system 502 and/or web server 504 of FIG. 5. A user of the administration interface may interact with enablement period management software through a web page 601 of a server that permits the user to perform the following tasks: the sale of EPs 610 to another registered user of the server application, which when initiated by a mouse click of an on-screen button widget 602 invokes the transmission of a sell EPs form 620 to the user's browser where form fields 621, 622, 624, and/or 626 are completed to describe the transaction to the server software application. The EP transfer may then be initiated by user input by selecting "transfer" button 628 after which a new view of the user web page 601 is retransmitted to the user's browser.

Indications of recent server application software actions that involve the user may be displayed in a dedicated "Your Recent Actions" frame 608, and Account History 604 may be available within the user web page 601. The examination and editing of the user's account information on a subsequent web page may be served to the user's browser when "Account Info" 606 receives user input (e.g., a cursor selection). The composition and transmission of an SMS message over the wireless mobile phone network to another registered user's mobile phone via a subsequent web page may be transmitted to the user's browser when "Send SMS" is selected via user input.

Another user of the administration interface of the enablement period management software who may have been granted administrator privileges by another administrator may interact with the server application through an embodiment of main web page 630 that contains all of the functions of the user web page 601, but with additional capabilities: the ability to transfer EPs from one registered user to another via transfer 634; the ability to create EPs in the administration privileged user account 636; the ability to add new users, to edit users' privileges, to delete users, and to edit users' account information 638; the ability to generate reports summarizing activities conducted through the server web application such as a report of EPs sold by a user or all users in a certain calendar period, or of money received by the sales of EPs in a certain calendar period or a report listing all registered users who have conducted a transaction using the server software in a certain calendar period 644; the ability to record the sale of a solar-powered lighting appliance to a customer, including the amount of the transaction, the creation of a new user account for the customer, the recording and associating of the newly-purchased solar-powered lighting appliance with the customer's account using the device's unique numerical designation, and the transfer of EPs onto the lamp that were included in the sales transaction bundle 640. Recent Actions 648 may indicate the most recently performed transactions.

As such, an interface may provide some or all of the functions as described in relation to administration controller 600. It should be understood that how such an interface is presented may be visually altered and contain additional or less functionality.

As illustrated in system 500, enablement period management software 508 may access one or more databases, such as database 506, which contains user account information. For instance, enablement periods that have been purchased by a user but have yet to be transferred to a mobile device may be stored in database 506 associated with a user's account. Database 506 may also store data regarding information about the user, such as a password and username. Biographical and geographic information may also be stored about the user. For instance, access by a user may only be permitted from a particular geographic region of the world (e.g., based on IP address). In some embodiments, for security reasons, EPs may be keyed to particular solar-powered lighting appliances. In such embodiments, database 506 may store an indication of the one or more EP keys for particular solar-powered lighting appliances.

Figure 7:
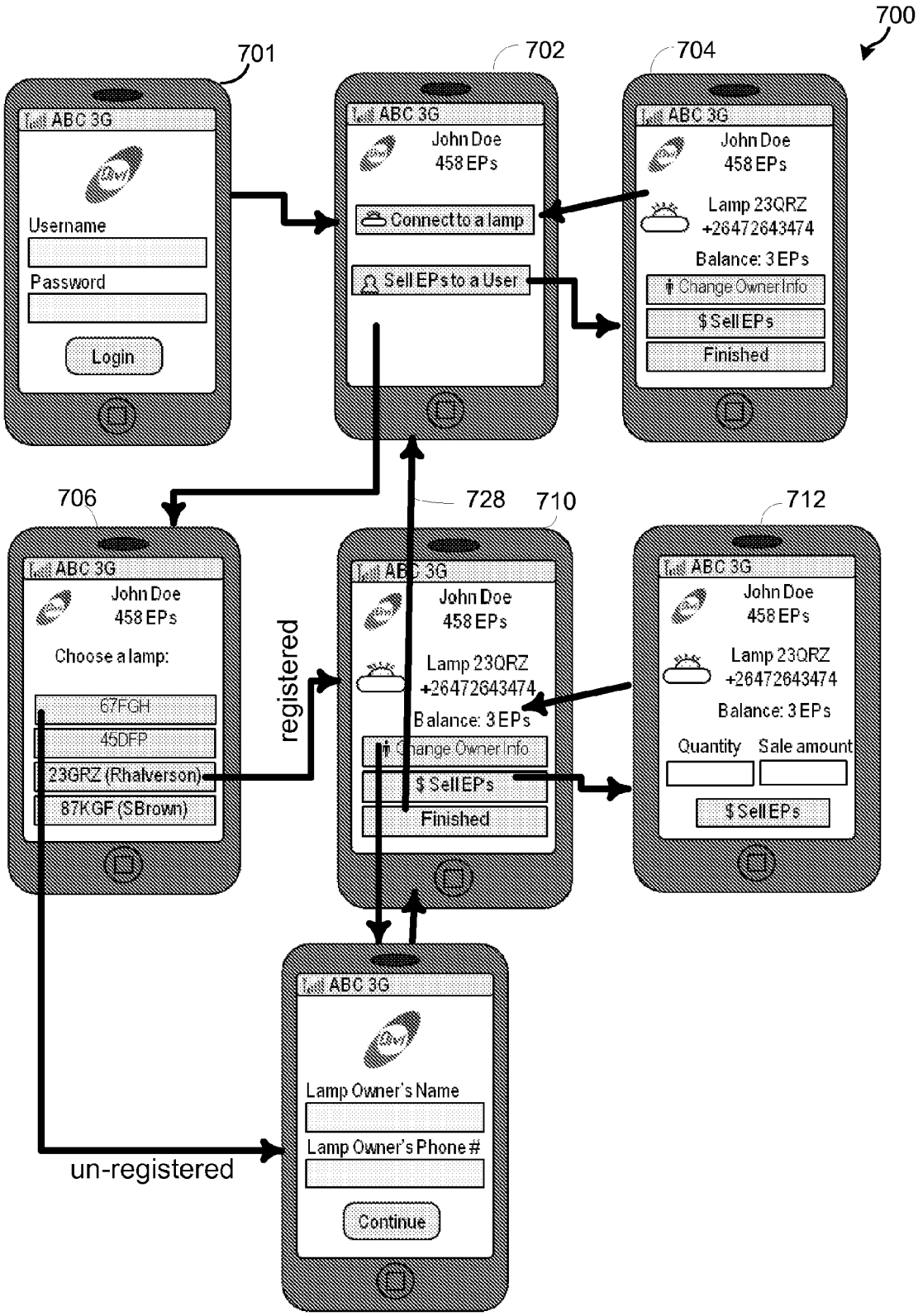
FIG. 7 illustrates screen shots of an embodiment of a mobile device being used as an administration controller for acquiring and selling enablement periods for solar-powered lighting appliances.

While FIG. 6 represents screen shots from the administration interface of the enablement period management software, FIG. 7 represents screen shots from a mobile device that may interact with the enablement period management software for purchase and distribution of enablement periods. FIG. 7 illustrates screen shots of an embodiment of a mobile device being used as an administration controller 700 for acquiring and selling enablement periods for solar-powered lighting appliances. The mobile device executing administration controller 700 may be mobile device 510 of FIG. 5 or some other mobile device. Arrows depicted in FIG. 7 indicate upon selection of an on-screen option the interface that is presented.

Upon launching the mobile phone sales application, a user may be required to log into their account via interface 701 on a remote server (e.g., web server 504 of FIG. 5) running enablement period management software that communicates with the mobile phone over a wireless mobile phone network and/or the Internet. After login, a subsequent screen in the application of interface 702 may display user selectable choices initiating either an operation to sell EPs to another registered user via interface 704 or an operation to create a communications channel to a proximate solar-powered lighting appliance via interface 706. If the operation selected is "Sell Credits to User," a new form may be displayed on the mobile phone screen where transaction information may be entered and the operation executed by a selection of the Sell button, which initiates the transfer on the remote server and returns the mobile phone screen to the previous interface 702.

If the "Connect to Lamp" button is touched, the mobile phone application may return interface 706 displaying the numerical identification number of the connected solar-powered lighting appliance. Connection may be through a cable or via a protocol such as Bluetooth® or Bluetooth® LE. In both cases, the mobile phone application may attempt to pair the numerical identification number with a known user name associated to the solar-powered lighting appliance through a database query to the remote server software application or, failing that, through a query to a local database stored on the mobile phone.

If the user selects a solar-powered lighting appliance from a discovered devices list of interface 706 that is not associated with a known user whose information is stored on the web server, interface 714, which contains a form where the solar powered lighting appliance owner information can be entered, is displayed. If a user selects a discovered device that is known or if the user has completed the registration of an unknown device, a new screen is displayed via interface 712 where EPs may be transferred to the selected device. In some embodiments, data, such as a serial number, or other form of identifier that is unique from the identifiers of other solar-powered lighting appliances may be acquired by the mobile device and transmitted to the web server. If EPs are paired to particular solar-powered lighting appliances, such a transfer may be necessary to obtain an acceptable EP.

Entering the required transaction information via interface 712 and using user input to select the "Sell Credits" indicator transmits the transaction information to the remote server where the server application software debits the user's EP account balance and initiates an operation in the mobile phone application to electronically transfer the specified number of EPs across the previously established mobile phone lighting device communications channel. Once complete, the mobile phone application displays the previous interface 710.

Figure 8:
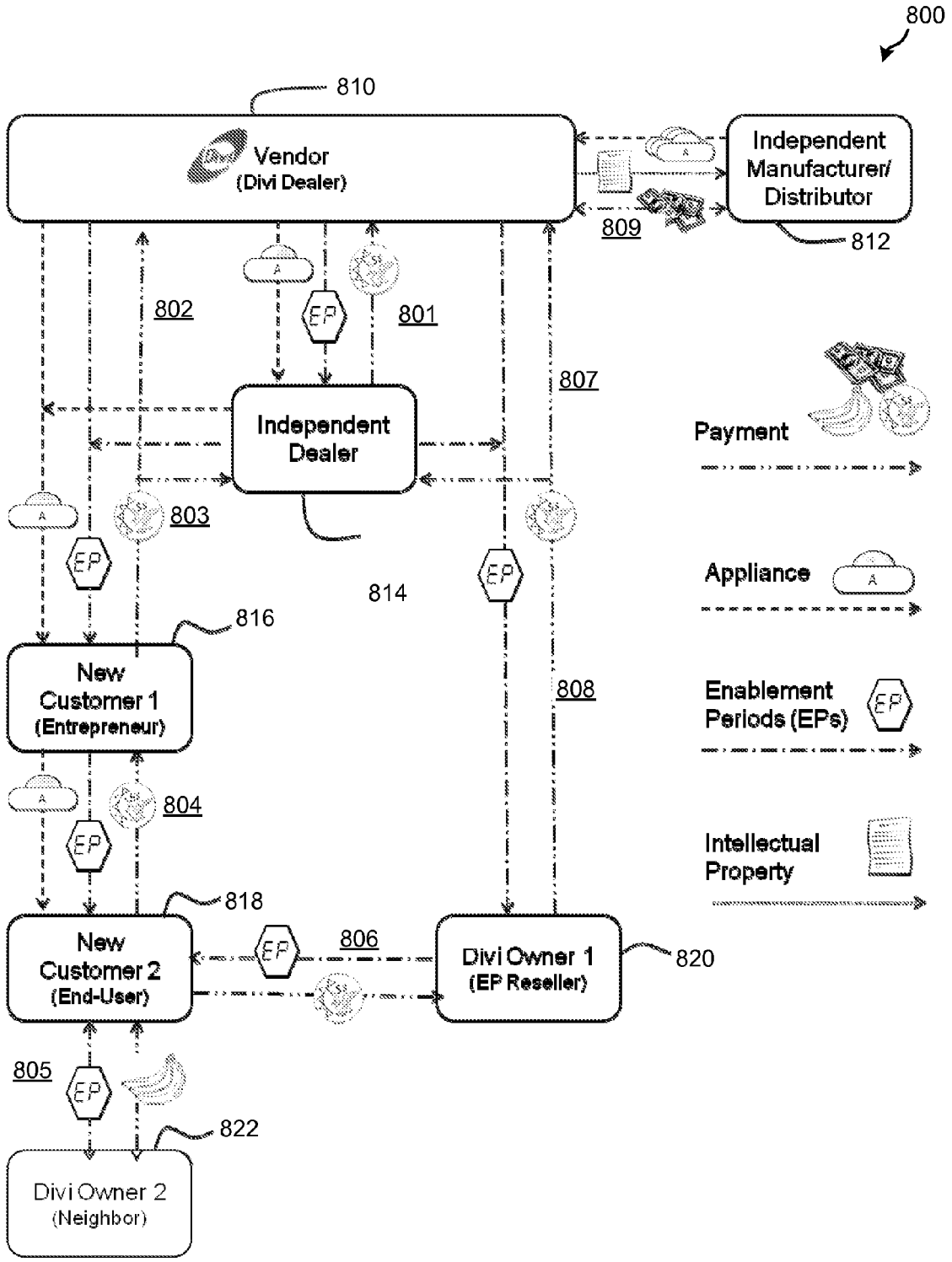
FIG. 8 illustrates an embodiment of a diagrammed method for selling, buying, and sharing solar-powered lighting appliances and enablement periods using the systems described herein.

FIG. 8 illustrates an embodiment of a diagrammed method 800 for selling, buying, and sharing solar-powered lighting appliances and enablement periods using the systems and interfaces described herein. Method 800 may avoid some of the drawbacks that could be envisioned with other methods of selling and buying electronically transferable products such as EPs. For example, in the mobile phone industry, electronically transferable products such as talk time, text messages, pictures, applications (i.e. apps) and similar products may be sold, bought, and possibly transferred electronically. However, often such methods include undesirable limitations. For example, a person desiring to buy, sell, or trade such products may be required to sign up for a mobile payment account. This may involve a person having to: travel to a city, present identification, fill out forms, sign an agreement and so forth. In areas where mobile phone service is absent or unreliable, transactions by mobile phone may be difficult or impossible. Moreover, in many such systems such as mobile payment systems, the mobile phone service operator charges the equivalent of a few cents or more for each transaction. Even small transaction fees, that may be acceptable in developed countries, may be hard to bear for persons in lesser developed countries. For example, a mobile payment transaction fee of 5 to 10 Kenyan shillings on a transaction in the range of 50 to 100 Kenyan shillings represents 10%-20% overhead in transaction cost. The systems described herein enable a variety of entities to engage in such transactions without the drawbacks described above, in particular with flexibility to avoid some of the financial overhead of the relatively high fees per transaction sometimes associated with mobile payment systems.

Entity 810 represents the Vendor/solar-powered lighting appliance dealer locations (such as in market centers) that sell solar-powered lighting appliances and EPs to Independent Dealers at wholesale prices and Customers at retail prices and manage regional distribution networks. Entity 812 represents an instance of an Independent Manufacturer/Distributor that may license solar-powered lighting appliance intellectual property for integration into products for distribution in countries where dealers are not located or integrate solar-powered lighting appliance technology into existing products for sale at solar-powered lighting appliance dealers under contract with the manufacturer of solar-powered lighting appliances. Solar-powered appliances may be manufactured by a Manufacturer 812 with "out-of-the box" stock or default capabilities with enhanced capabilities activated or enabled subsequently by vendor 810. For example, Vendor 810 may design the firmware in the solar-powered appliance to enable a version of the appliance to be manufactured and sold wherein the enablement period/payment technology is not included, i.e. the appliance may be charged, the light may be turned on/off, and a mobile phone may be charged by the appliance, all without any enablement period interactions of any kind. However, such an appliance may be upgraded at any time by vendor 810 or by a vendor authorized distributor 812 or an independent dealer 814 to include firmware, such as firmware that enables the appliance to operate in an enablement period mode where EPs may be paid for and transferred until enough EPs have been used and the appliance is fully paid for.

Entity 814 represents an Independent Dealer that has established retail outlets that may purchase solar-powered lighting appliances and EPs from solar-powered lighting appliance dealers at wholesale prices and sell for retail prices. Entity 816 represents New Customer 1. A customer may purchase a solar-powered lighting appliance and EPs for his own use and/or extra solar-powered lighting appliances and EPs for sale, such as at a price above the retail price. Entity 818 represents New Customer 2. Such a customer may purchase a solar-powered lighting appliance and EPs for his or her own use and may purchase additional EPs from an EP reseller or borrow or barter for EPs from a neighbor (or some other person). Entity 820 represents an Owner of a solar-powered lighting appliance that may purchase extra EPs for sale or trade to customers. Entity 822 represents a solar-powered lighting appliance of a second owner that lends extra EPs to neighbors or family members. EPs owned by persons may be stored electronically on a mobile device (e.g., a mobile phone), a web server (e.g., web server 504 of FIG. 5), or a solar-powered lighting appliance (e.g., solar-powered lighting appliance 302 of FIG. 3)

At step 801, Vendor 810 may distribute a solar-powered lighting appliance to an Independent Dealer that pays the Vendor a wholesale price for products and EPs and may sign dealer agreements. At step 802, New Customer 1 purchases one or more solar-powered lighting appliances and EPs for a purchase price at a Vendor location, such as a market center. EPs may be transferred to the solar-powered lighting appliance via a mobile device or a computer system. In some embodiments, a solar-powered lighting appliance is sold with a predetermined number of EPs available for activation, such as five (thus, the customer's only initial cost is purchase of the solar-powered lighting appliance without initial purchase of additional EPs being immediately necessary). Alternatively, at step 803, New Customer 1 may purchase one or more solar-powered lighting appliances and EPs for a purchase price at an Independent Dealer location. At step 804, New Customer 2 may purchase marked-up solar-powered lighting appliances and EPs from New Customer 1. At step 805, New Customer 2 and neighbors or family members (or some other person) of solar-powered lighting appliance Owner 2 share, barter, or otherwise exchange EPs as needed between solar-powered lighting appliances. At step 806, New Customer 2 may purchase, share, barter, or otherwise transact EPs with solar-powered lighting appliance Owner 1. The transfer of the one or more EPs may be from a solar-powered lighting appliance to a solar-powered lighting appliance or from a mobile device to New customer 2's solar-powered lighting appliance. At step 807, solar-powered lighting appliance Owner 1 may purchase additional EPs from solar-powered lighting appliance Vendor or via a mobile banking platform. The transfer of the one or more EPs may be from a solar-powered lighting appliance to a solar-powered lighting appliance or from a mobile device to New customer 1's solar-powered lighting appliance. At step 808, solar powered lighting appliance Owner 1 purchases additional EPs from Independent Dealer 814. The transfer of the one or more EPs may be from a solar-powered lighting appliance to a solar-powered lighting appliance or from a mobile device to New customer 1's solar-powered lighting appliance. At step 809, Independent Manufacturer/Distributor pays to license solar-powered lighting appliance technology for integration into its products and/or solar-powered lighting appliance contracts with Independent Manufacturer/Distributor 812 to integrate solar-powered lighting appliance technology into existing products for sale through solar-powered lighting appliance Vendor 810.

Figure 9:
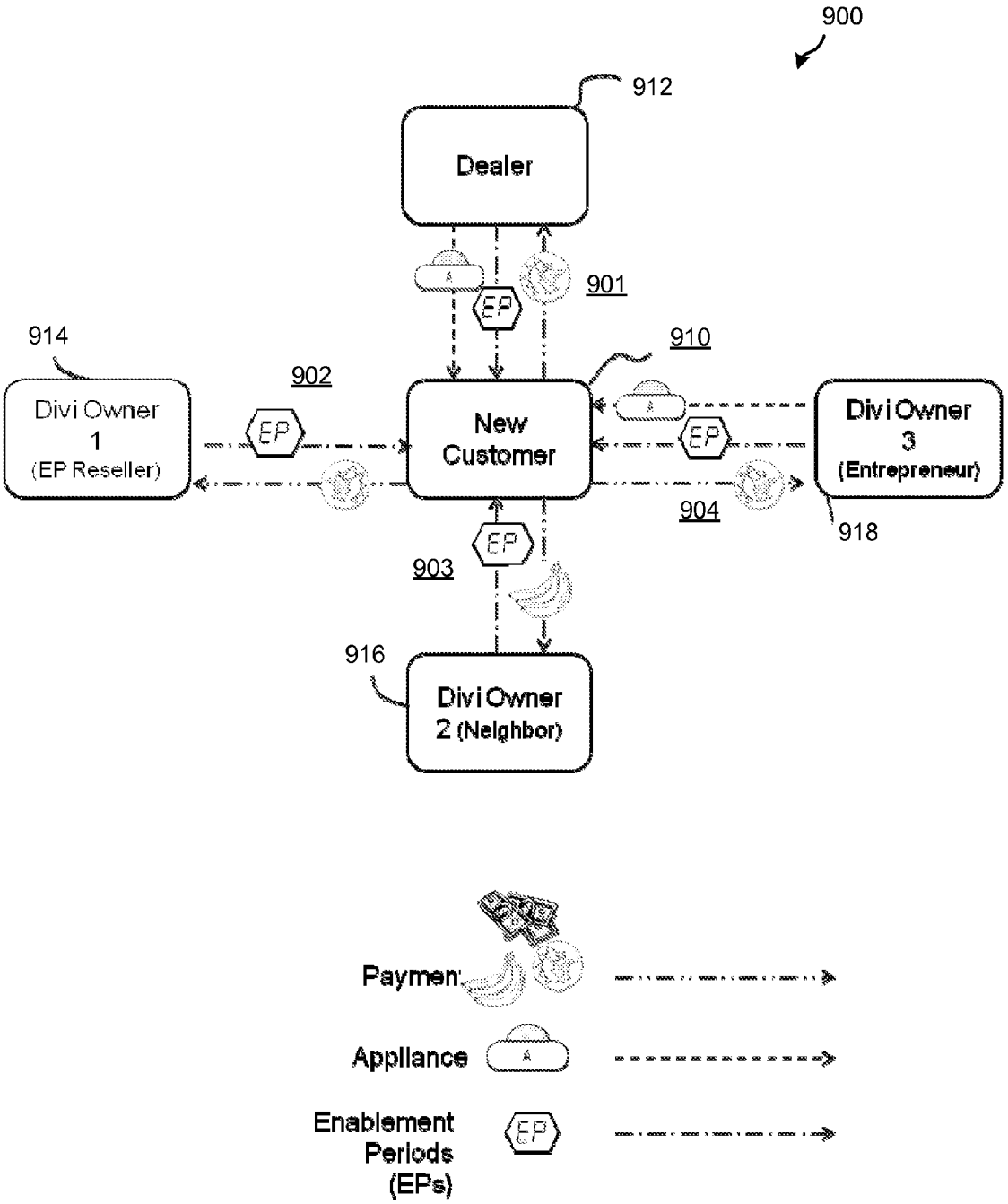
FIG. 9 illustrates another embodiment of a diagrammed method for selling, buying and sharing solar-powered lighting appliances and enablement periods using the systems described herein.

FIG. 9 illustrates an embodiment of a diagrammed method 900 for selling, buying, and sharing solar-recharged lighting and enablement periods using the systems described herein. At step 901, a customer 910 may purchase a solar-powered lighting appliance and enablement periods ("EPs") from a solar-powered lighting appliance dealer or an independent dealer for a retail price. EPs may be transferred to the solar-powered lighting appliance via a mobile device or a computer system. In some embodiments, a solar-powered lighting appliance is sold with a predetermined number of EPs available for activation, such as five (thus, the customer's only initial cost is purchase of the solar-powered lighting appliance without initial purchase of additional EPs being immediately necessary).

At step 902, the customer 910 purchases EPs from solar-powered lighting appliance Owner 914, an EP Reseller, for a price. EPs may be transferred to the solar-powered lighting appliance via a mobile device or a computer system. At step 903, the customer 910 buys, barters for, or borrows EPs from solar-powered lighting appliance Owner 916, a neighbor, family member, or some other person. EPs may be transferred to the solar-powered lighting appliance via a mobile device or a computer system. At step 904, a customer 910 may purchase a solar-powered lighting appliance and EPs from solar-powered lighting appliance Owner 918, an entrepreneur in the community, for a price. Entity 912 represents a solar powered lighting appliance Dealer and an independent dealer location. Entity 914 may represent a solar-powered lighting appliance Owner 1 that purchases extra EPs for sale, trade, barter, gift, etc. to others, such as customers. Entity 916 may represent solar-powered lighting appliance Owner 2 that lends extra EPs to neighbors or family members. Entity 918 may represent solar-powered lighting appliance Owner 3 that purchased a solar-powered lighting appliance and EPs for his or her own use and one or more extra solar-powered lighting appliance and EPs for sale in informal shops and markets, such as at a price above the retail price.

Figure 10:
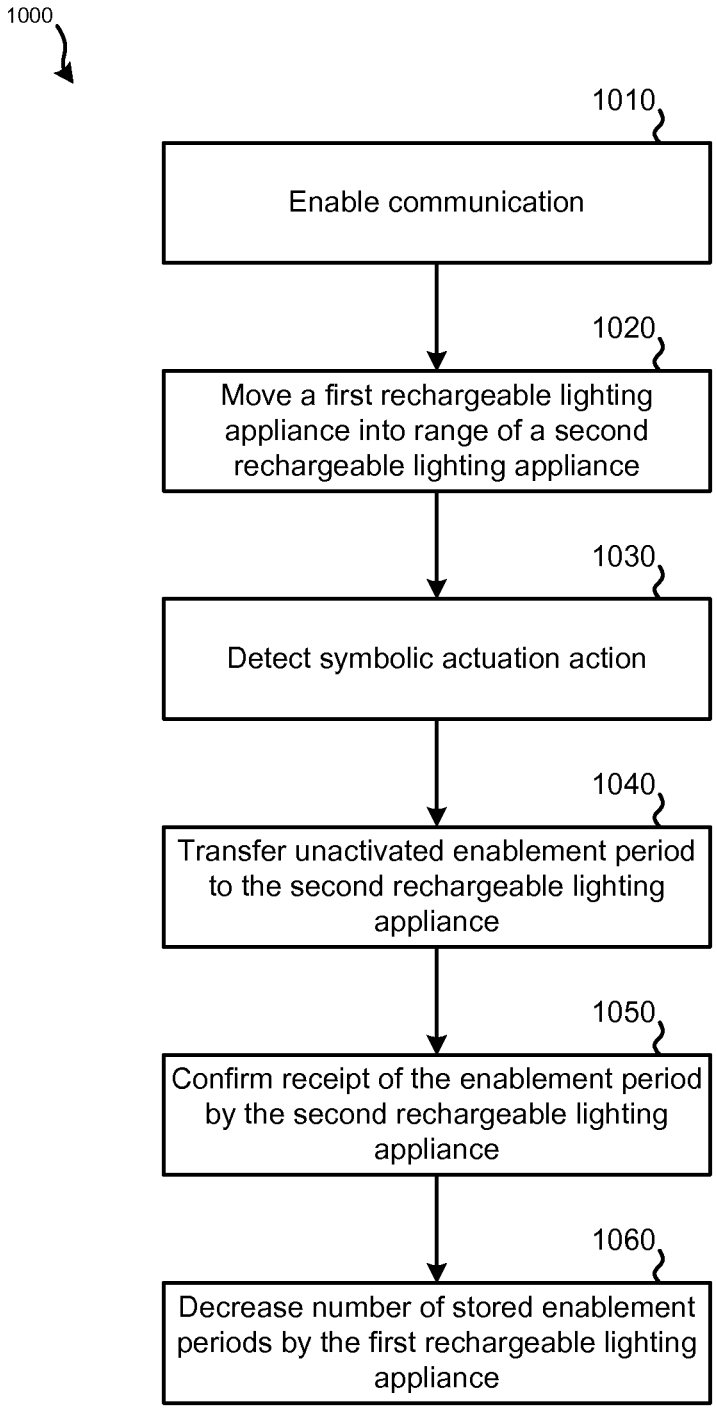
FIG. 10 illustrates an embodiment of a method for transferring an enablement period from a first solar-powered lighting appliance to a second solar-powered lighting appliance.

FIG. 10 illustrates an embodiment of a method 1000 for transferring an enablement period from a first rechargeable solar-powered lighting appliance to a second rechargeable solar-powered lighting appliance. The solar-powered lighting appliances of method 1000 may be the same or similar to the previously detailed solar-powered lighting appliances detailed herein. For example, solar-powered lighting appliance 302 of FIG. 3 may be used to performed method 1000. In some embodiments, some other form of rechargeable and/or solar-powered lighting appliance, or, more generally, a rechargeable appliance, may be used in accordance with method 1000. Means for performing the steps of method 1000 include one or multiple instances of components of solar-powered lighting appliance system 300, one or more processors, and/or one or more non-transitory storage mediums.

In some embodiments, the first rechargeable light appliance may be a smart phone that is rechargeable and which is configured to detect a request for a transfer of EPs either via a symbolic actuation action (e.g. such as shaking or pouring from a smart phone with an accelerometer) or via conventional smart phone input interfaces. An enablement period may only be permitted to be transferred from the first lighting appliance to the second lighting appliance if the enablement period has not yet been activated (that is, used for enabling use of the light of the first rechargeable lighting appliance). Once an EP is activated, it may not be permissible to transfer the activated EP. In method 1000, it may not matter which mode either of the lighting appliances are in. One or both lighting appliances may be in a first mode which requires the activation of an enablement period to permit the light to be continuously illuminated during a first period of time (e.g., a day) for longer than a second period of time (e.g., 1 second); or one or both of the lighting appliances may be in a second mode that allows for unlimited use of the light without activation of an enablement period.

At step 1010, (wireless or wired) communication of each lighting appliance may be enabled. This may involve a user activating a switch on each rechargeable lighting appliance or performing a symbolic actuation action with each rechargeable lighting appliance, such as shaking, rotating, or inverting the rechargeable lighting appliance. Not having communication, such as Bluetooth®, continuously activated may conserve power and/or prevent accidental transfers of EPs.

At step 1020, the first lighting appliance and the second lighting appliance may be moved within communication range of each other. This may involve the lighting appliances being moved within several feet of each other. The distance may be contingent on factors such as the wireless protocol being used, RF interference, and/or the transmitting power used by each lighting appliance. Also at step 1020, via a discovery process, each rechargeable lighting appliance may acknowledge the presence of the other rechargeable lighting appliance, such as by briefly flashing their respective lights. This flashing of the light may occur regardless of whether EPs are currently present on the rechargeable lighting appliance. As such, the light may be used to provide a user with information (but not a continuous source of light), even when the lighting appliance is out of EPs. Such flashing may also serve to confirm that each lighting appliance has sufficient battery charge to communicate and conduct a transfer of the one or more EPs and that the lighting appliances have successfully paired with each other (and not some other lighting appliance or other device in the area).

At step 1030, a user may perform a symbolic actuation action (or some other form of user input) to initiate the transfer of one or more EPs using the first lighting appliance (the lighting appliance that the EP is being transferred from). The symbolic actuation action may involve tipping the first lighting appliance upside down or shaking the first lighting appliance. The symbolic actuation action may be detected by the first rechargeable lighting appliance and may serve as a trigger for the first lighting appliance to send an EP to the second lighting appliance (the lighting appliance that is receiving the EP). In other embodiments, the symbolic actuation action may be performed with the second lighting appliance. In some embodiments, a symbolic actuation action may be performed using each lighting appliance. In some embodiments, rather than a symbolic actuation action, some other form of user input, such as pushing a button on one or both of the rechargeable lighting appliances, may be used to provide input to the rechargeable lighting appliance to initiate the transfer.

At step 1040, an unactivated EP may be transferred from the first lighting appliance to the second lighting appliance in response to the symbolic actuation action being detected by the first (and/or second) lighting appliance. Wireless communication, such as via Bluetooth®, may occur between the first and second lighting appliance, resulting in data being exchanged. The data exchanged may result in an EP from the first lighting appliance being transferred to the second lighting appliance. Such a transfer may only be permitted if one or more unactivated EPs are available on the first lighting appliance.

At step 1050, receipt of the received EP by the second lighting appliance may be acknowledged by the second lighting appliance, such as by flashing its light. A confirmation message may also be transferred from the second lighting appliance to the first lighting appliance to confirm that the EP has been successfully received by the second lighting appliance. Such a confirmation may prevent the first lighting appliance from sending an EP but the EP never actually being received by the second lighting appliance.

At step 1060, in response to the confirmation, the first lighting appliance may decrease the number of unactivated enablement periods stored in response to the EP being successfully transferred to the second lighting appliance. Also at step 1060, the second lighting appliance may increase the number of unactivated enablement periods stored by the second lighting appliance.

The same EP may be transferred again, such as from the second lighting appliance to a third lighting appliance or back to the first lighting appliance. The EP may no longer be permitted to be transferred once the EP is activated to allow for the light of a lighting appliance currently possessing the EP to be used for the predefined period of time associated with EPs, such as a day, week, month, ten-day period, etc. When an EP is activated by a lighting appliance, a count of lifetime activated EPs on the lighting appliance may be increased.

Figure 11:
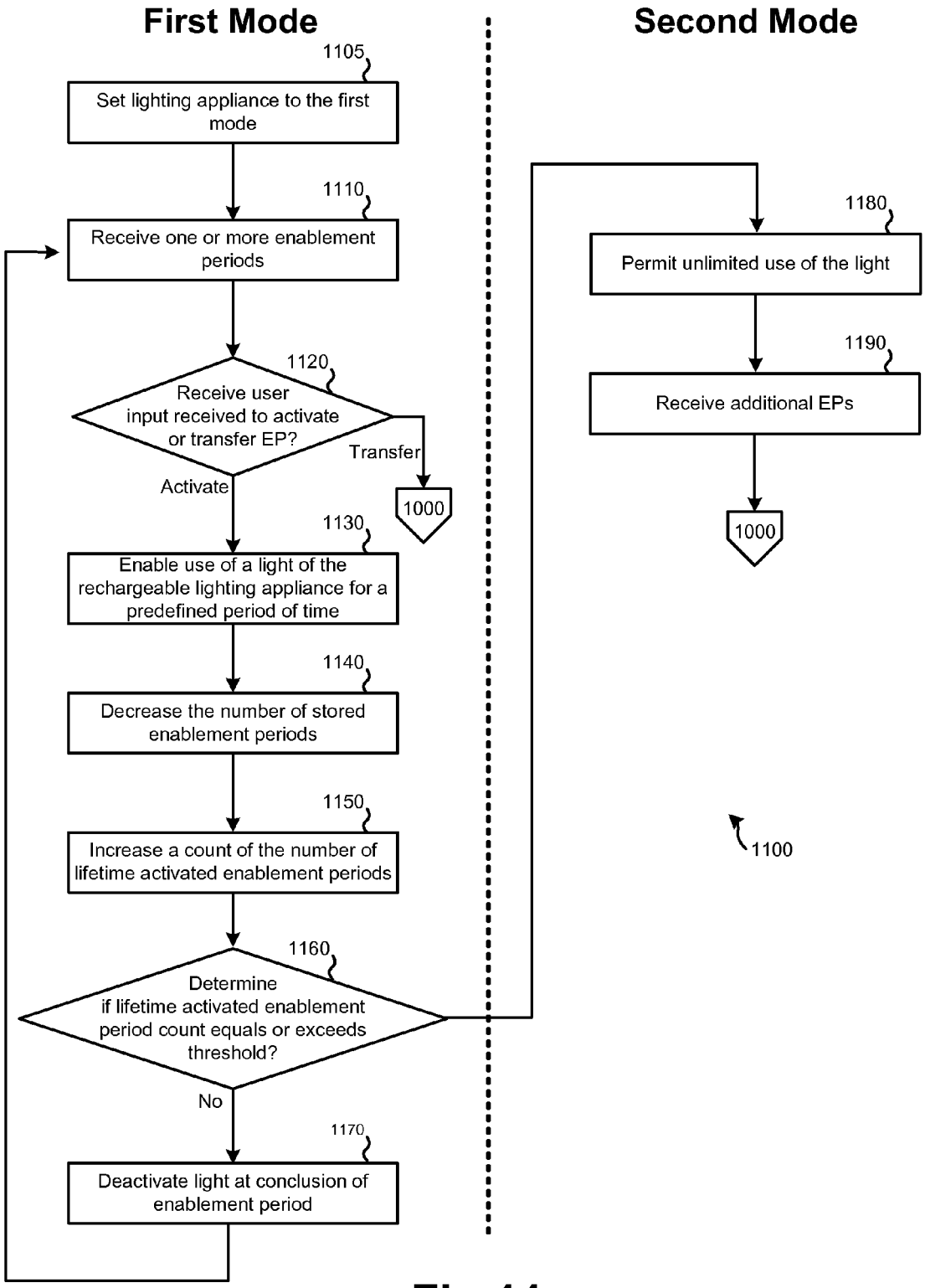
FIG. 11 illustrates an embodiment of a method for controlling use of a solar-powered lighting appliance until a second mode is realized.

FIG. 11 illustrates an embodiment of a method 1100 for controlling use of a lighting appliance (which may be solar-powered and/or rechargeable) in a first mode until a second mode is entered. The lighting appliances of method 1100 may use the previously-detailed lighting appliances, such as solar-powered lighting appliance 302 of FIG. 3. Means for performing the steps of method 1100 include one or multiple instances of components of solar-powered lighting appliance system 300, one or more processors, one or more computer systems, and/or one or more non-transitory storage mediums. In some embodiments, some other form of rechargeable lighting appliance, or, more generally, a rechargeable appliance, which may be solar-powered, may be used in accordance with method 1100. An enablement period may only be permitted to be transferred from a first lighting appliance to a second lighting appliance if the enablement period has not yet been activated (that is, used for enabling use of the light of the first rechargeable lighting appliance). Once an EP has been activated, it may not be permissible to transfer the EP to another lighting appliance.

In FIG. 11, the first mode (also referred to as an EP controlled mode) is a mode of a lighting appliance in which activation of an EP is required to use a light of the rechargeable lighting appliance for lighting for a first predefined period of time, such as a day. During this first predefined period of time, a user may turn on and off the light of the lighting appliance as much as desired. During the first predefined period of time of an activated enablement period, the only limiting factor on use of a light of the lighting appliance may be whether sufficient charge is available in one or more rechargeable batteries of the lighting appliance. If an enablement period is not activated, use of the light of the rechargeable lighting appliance may be prohibited or restricted while the lighting appliance is in the first mode. When an enablement period is not activated while the lighting appliance is in the first mode, a light of the rechargeable lighting appliance may be lit for a short time (e.g., a few seconds) to confirm operability, charge, and/or acknowledge a communication link with another device. Whether or not an enablement period has been activated, the rechargeable lighting appliance may be charged. If an external device connection for charging an external device is present, the connection may only be enabled in the first mode when an enablement period is activated. Otherwise, while the lighting appliance is in the first mode, the external device connection may be disabled (and, thus, unavailable for use in charging an external device).

In the second mode, unlimited use of the light (and/or an external device connection for charging) of the rechargeable lighting appliance may be permitted. As such, activating enablement periods in order to use the light of the rechargeable lighting appliance may not be necessary (or permitted) if the rechargeable lighting appliance is in the second mode. Similarly, activating enablement periods (or permitted) while in the second mode may not be necessary for using an external device connection to charge an external device. While in the second mode, activation of an enablement period may be prohibited by the lighting appliance. While in the second mode, a lighting appliance may receive and transmit enablement periods. The lighting appliance may be charged at any time while in the second mode.

A lighting appliance may be initially set to the first mode at step 1105. As such, at manufacture or initial programming, the lighting appliance may be set to the first mode and may be configured to switch to the second mode after a predefined number of EPs have been activated on the lighting appliance. When initially set to the first mode, a number of unactivated enablement periods may be added to the lighting device. In some embodiments, a lighting device is distributed with no unactivated EPs. Further, at manufacture or initial programming, a number of enablement periods is defined that must be activated by the lighting appliance in order for the second mode to be entered.

At step 1110, one or more enablement periods may be received by a lighting appliance. This may occur from a computer system, a mobile device (e.g., a cellular phone), or another lighting appliance. Received enablement periods may be added to a number of enablement periods, if any, already stored by the lighting appliance. These enablement periods may not yet be activated.

At step 1120, user input may be received. This user input may specify that either an enablement period is to be activated (such that the rechargeable lighting appliance can be used for lighting for a first period of time) or the EP is to be transferred to another rechargeable lighting appliance. Different forms of user input may be used to trigger either the transfer or the activation of an enablement period. For example, a pouring symbolic actuation action may be used to initiate a transfer while a shaking symbolic actuation action may activate an enablement period. In some embodiments, another form of user input, such as a push of a button of the lighting appliance, is used to activate an enablement period. If a transfer of an EP to another rechargeable lighting appliance is to occur, method 1000 of FIG. 10 or a similar method may be followed. If the user input indicates the enablement period is to be activated, method 1100 may proceed to step 1130.

At step 1130, a light of the rechargeable lighting appliance may be enabled for use for a predefined period of time in response to an EP being activated. Each enablement period may be for the same amount of time, such as an hour, a day, week, 5-day period, 10-day period, month, etc. During the activated enablement period, the light of the rechargeable lighting appliance may be used as much (or as little) as the user desires. During the activated enablement period, a limiting factor on use of the light may be the charge of one or more batteries of the rechargeable lighting appliance. Prior to, during and/or after use of the lighting appliance, a solar panel may be used to charge the rechargeable batteries. As such, despite an enablement period being used, a user may need to ensure that the rechargeable lighting appliance is sufficiently charged to permit the desired amount of usage. The predefined period of time of the enablement period may run continuously from the time of activation until the expiration of the period of time of the EP regardless of how much or how little the lighting appliance is used. During this period of time, an external device connection of the lighting appliance may be enabled to permit charging of an external device. Similar to the light of the lighting appliance, a user may need to ensure that the lighting appliance is sufficiently charged to permit the desired amount of usage of the external device connection. A lighting appliance may always maintain a minimum stored battery charge or have backup battery, such that when the light is unable to be used due to a lack of charge, use of EPs can still be monitored.

At step 1140, the number of unactivated enablement periods stored by the rechargeable lighting appliance may be decreased (such as by one) in response to activation of the enablement period at step 1130. Once the rechargeable lighting appliance has no more unactivated enablement periods stored, more enablement periods may need to be added to the rechargeable lighting appliance before the light (and/or an external device connector) can be enabled for use again. At step 1150, a count of the number of lifetime activated enablement periods may be increased in response to the activation of the enablement period of step 1130. This number may not decrease. As such, for each enablement period activated, the lifetime activated enablement period count may increase by one.

At step 1160, if the lifetime activated enablement period count equals (or exceeds) a predefined threshold value, the rechargeable lighting appliance is switched from the first mode to the second mode. The predefined threshold value may be set by the merchant or manufacturer of the rechargeable lighting appliance, such as at step 1105. For example, if the predefined threshold value is 20, this would mean that 20 enablement periods are required to be activated on the lighting appliance for the lighting appliance to transition from the first mode to the second mode. Enablement periods that are loaded onto a rechargeable lighting appliance but are not activated (such as enablement periods that are later transferred to another lighting appliance) may not count toward the lifetime activated enablement period count.

If the lifetime activated enablement period count does not equal or exceed the predefined threshold value, at the conclusion of the currently activated enablement period, the light (and/or the external device connection) of the lighting appliance may be deactivated at step 1170. To reactivate the light (and/or the external device connection), another enablement period may need to be activated. As such, method 1100 returns to step 1110 following step 1170. Further, one or more additional enablement periods may be added to the rechargeable lighting appliance. For instance, if the rechargeable lighting appliance is out of enablement periods, at least one enablement period may need to be loaded to the lighting appliance before the light can again be used for lighting.

Returning to step 1160, if the lifetime activated enablement period count equals or exceeds the predefined threshold value, method 1100 may proceed to step 1180 from step 1160. At step 1180, the lighting appliance may be set to the second mode. Once in the second mode at step 1180, unlimited use of the light (and/or external device connector for charging) of the lighting appliance may be permitted. A limiting factor may be charging of the battery of the rechargeable lighting appliance. As such, once in the second mode, as long as a user keeps the lighting appliance charged, the light and/or external device connector of the rechargeable lighting appliance may be used as much as desired. At step 1180, no additional enablement periods may need to be loaded for use of the lighting appliance. However, a user may still desire to load enablement periods such that these EPs may later be transferred to other lighting appliances (which may also be owned by the user or by some other person). Once a rechargeable lighting appliance is in the second mode, it may not revert to the first mode (that is, the second mode may be permanent).

At step 1190, additional enablement periods may be loaded on the rechargeable lighting appliance. These enablement periods may be prohibited from being activated on the rechargeable lighting appliance, since unlimited use of the light of the rechargeable lighting appliance is already permitted. Any enablement periods loaded at step 1190 may be transferred to another rechargeable lighting appliance according to method 1000 or a similar method.

Figure 12:
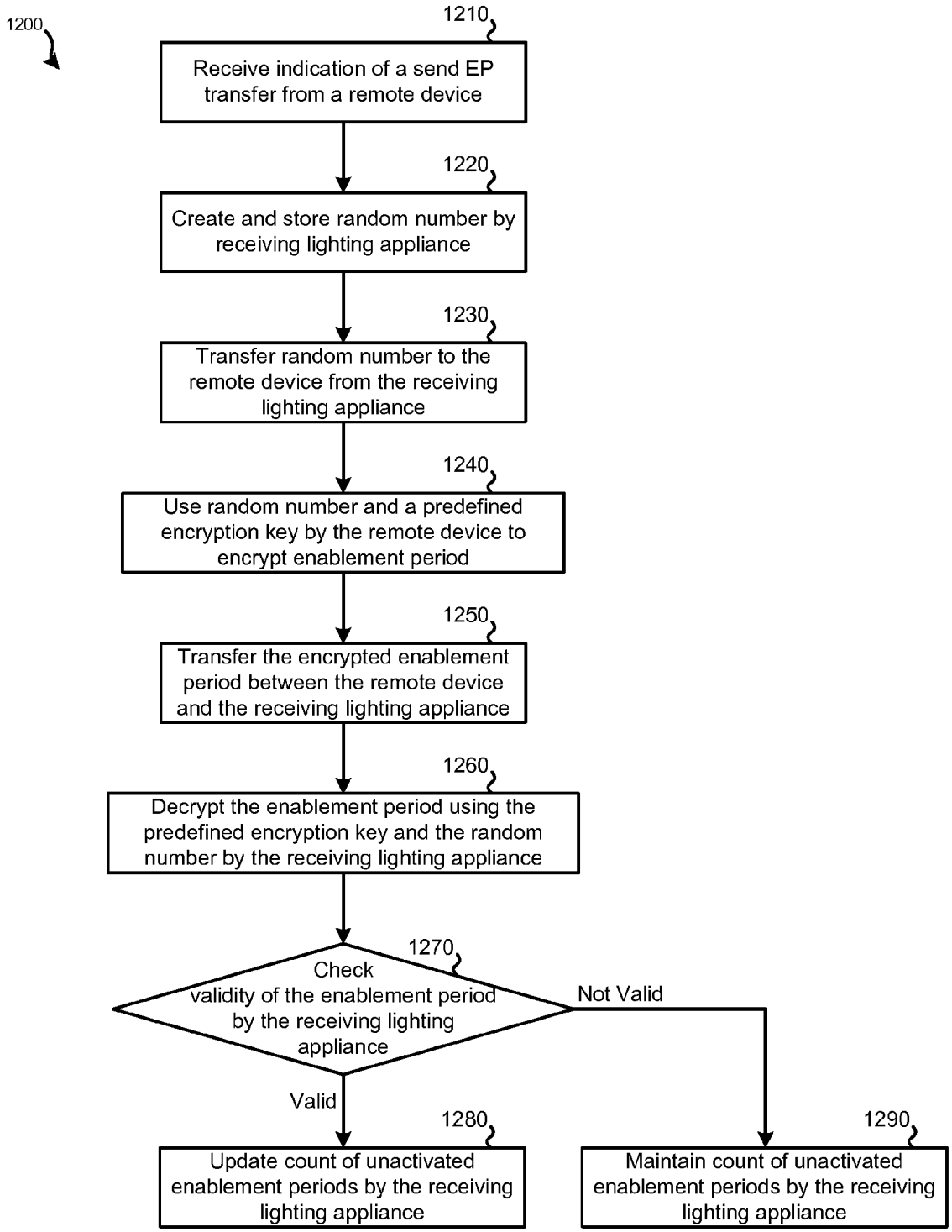
FIG. 12 illustrates an embodiment of a method for encrypting communication between devices that are exchanging one or more EPs.

Since EPs are necessary, at least initially, to activate a lighting appliance for use, it may be beneficial to encrypt or otherwise protect communication involving transfer of one or more EPs to prevent unscrupulous persons from creating "fake" EPs (without actually purchasing the EP). FIG. 12 illustrates an embodiment of a method for encrypting communication between devices that are exchanging one or more EPs. Method 1200 may be applied to transfers of EPs from a mobile device (e.g., cellular phone) or from a computer system to a lighting appliance and to transfers of EPs between two lighting appliances. Method 1200 may be performed by the previously described lighting appliances. Method 1200 may, for example, be performed as part of method 400 of FIG. 4 or as part of method 1000 of FIG. 10. Method 1200 may involve the use of symmetric AES (Advanced Encryption Standard). Means for performing the steps of method 1200 include one or multiple instances of components of solar-powered lighting appliance system 300, one or more processors, computer systems, mobile devices, and/or one or more non-transitory storage mediums.

At step 1210, a lighting appliance that is to receive an enablement period may receive an indication of a transfer transaction from a remote device. The remote device may be another lighting appliance or may be some other form of device, such as a computer system or cellular phone. For instance, referring to method 1000, such an indication of a transfer transaction may be received by the receiving lighting appliance prior to transfer of an unactivated enablement period at step 1040. Such an indication may be part of the pairing of the devices.

In response to receiving the indication of the transfer transaction from the remote device, the receiving lighting appliance may create and store a random number at step 1220. In some embodiments, rather than creating a random number, a random number may have been previously created and stored by the receiving lighting appliance. As defined herein, a random number may be a random number, pseudo-random number, quasi-random number, hash code, or any generatable numerical value or function suitable for security applications.

At step 1230, the random number created and stored at step 1220 may be transferred to the remote device from which the indication of the transfer transaction was received. This random number may be transferred via a local wireless protocol, such as Bluetooth®, or via a wired communication link. In AES, a random number may be incorporated as a component of an encryption key used by both the receiving lighting appliance (for decryption) and the remote device (for encryption). Since it is likely that an unscrupulous user would be attempting to send "fake" EPs, the device that is to send the EPs should not specify the random number. Rather, the receiving lighting appliance specifies the random number to be used to create the encryption key.

At step 1240, the remote device that is to send the EP to the receiving lighting appliance may use the received random number and an encryption key to encrypt an EP. The random number and a predefined encryption key component may be combined to create the encryption key that is used to encrypt the EP. The predefined encryption key component may be stored by both the remote device and the receiving lighting appliance. However, this predefined encryption key component is not be transmitted between the two devices. As such, it may be difficult or impossible for an unscrupulous user to determine the predefined encryption key component from transmissions between the remote device and the receiving lighting appliance.

At step 1250, the encrypted EP may be transferred from the remote device to the receiving lighting appliance. In order to decrypt the encrypted EP, it may be necessary for the receiving lighting appliance to have the predefined encryption key component and the random number to create the encryption key. At step 1260, the EP may be decrypted by the receiving lighting appliance using the random number that was stored at step 1220 and the predefined encryption key component, which is also stored by the receiving lighting appliance. The encryption key may be created by the receiving lighting device from the random number and the predefined encryption key component in the same manner as the remote device created encryption key. The predefined encryption key component is not transmitted between the receiving lighting appliance and the remote device.

At step 1270, the validity of the EP decrypted at step 1260 may be checked by the receiving lighting appliance. In some embodiments, by virtue of the EP being able to be properly decrypted, the validity of the EP may be confirmed. In other embodiments, certain characteristics of the EP may be checked (such as an embedded code) for validity. If valid, at step 1280, the count of unactivated enablement periods stored by the receiving lighting appliance may be updated (e.g., increased by one). If the enablement period is determined to not be valid at step 1270, the current count of unactivated enablement periods may not be increased or otherwise updated by the receiving lighting appliance at step 1290. In some embodiments, if the enablement period is determined to be invalid, this may be evidence of tampering and the lighting appliance may be disabled. Disabling such of receiving lighting appliance may include temporarily disabling it for a predefined period of time, permanently disabling it, or disabling it until a reactivation input is provided by an authorized user.

Figure 13:
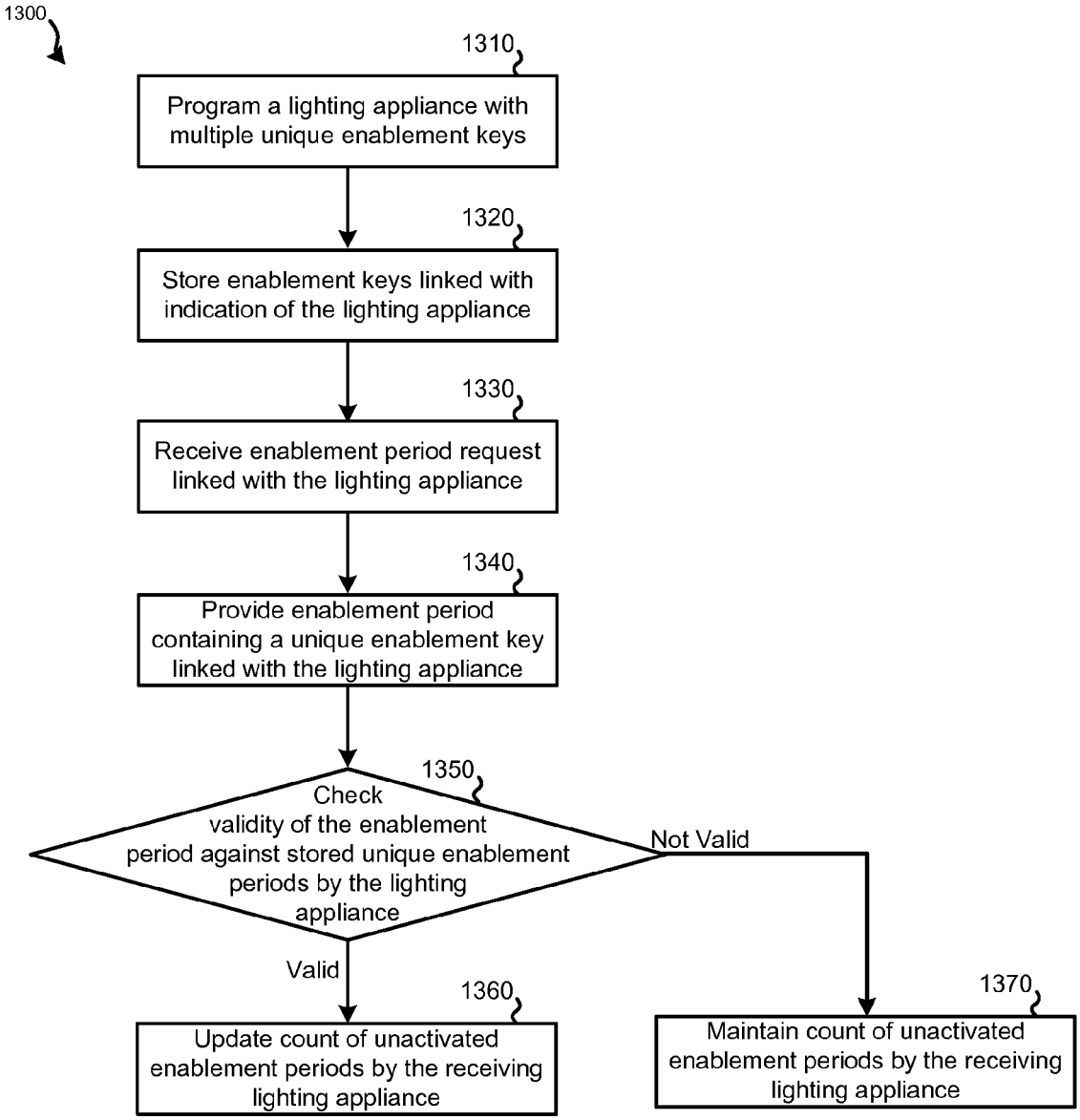
FIG. 13 illustrates an embodiment of a method for using single-use enablement periods.

In other embodiments, since EPs are necessary, at least initially, to activate a lighting appliance for use, it may be beneficial to key EPs to a particular lighting appliance. As such, a copy of the same EP may not be used on another lighting appliance or multiple times with the same lighting appliance. FIG. 13 illustrates an embodiment of a method 1300 for using single-use enablement periods. Method 1300 may be applied to transfers of EPs from the mobile device (e.g., cellular phone) to a lighting appliance and to transfers of EPs between two lighting appliances. Method 1300 may be performed by the previously described lighting appliances. Method 1300 may, for example, be performed as part of method 400 of FIG. 4 or as part of method 1000 of FIG. 10. Means for performing the steps of method 1300 include one or multiple instances of components of solar-powered lighting appliance system 300, one or more processors, computer systems, mobile devices, and/or one or more non-transitory storage mediums.

At step 1310, a lighting appliance may be programmed with multiple unique enablement keys. These unique enablement keys may be unique from some or all other enablement keys programmed into other lighting appliances. The programming of the lighting appliance with the unique enablement keys may occur at the time of manufacture of the lighting appliance or by a merchant/distributor. A sufficient number of unique enablement keys may be programmed into the lighting appliance to match the number of enablement periods that are necessary to be activated by the lighting appliance in order to transition from the first mode to the second mode. The multiple unique enablement keys that are programmed into the lighting appliance may be stored and linked with an indication, e.g. an identifier, of the lighting appliance at step 1320. The multiple unique enablement keys may be stored by database such as database 506 of web server 504. Database 506 may also store an indication of the lighting appliance, such as a serial number of the lighting appliance, linked with the unique enablement keys. Accordingly, the database 506 may store enablement keys for many lighting appliances.

After the lighting appliance has been distributed to a merchant and/or sold by the merchant to a user, an enablement period may need to be loaded onto and activated on the lighting appliance in order to enable use of the lighting appliance. In order to receive an EP for the lighting appliance, the EP may need to be specifically keyed to one of the unique enablement key of the lighting appliance. Referring to FIG. 5, an enablement key may need to be retrieved from database 506 for an EP. Mobile device 510 may request a unique enablement key linked with the particular lighting appliance from web server 504 based on a serial number or other identifier of the lighting appliance. A user may enter a serial number or other identifier of the lighting appliance into mobile device 510. Alternatively, mobile device 510 may communicate with the lighting appliance in order to retrieve an identifier, such as a serial number, from the lighting appliance. At step 1330, the request for an EP that indicates an identifier of the lighting appliance may be received by the web server. For example, an agent of a school that wishes to provide solar-powered lighting appliances for students to use as study lamps may initiate requests for EPs for students receiving study lamps via a mobile device such as a smart phone. In one example embodiment, the agent may be in data communication via a smart phone application with the server and with the solar-power lighting appliance, e.g. study lamp. Alternatively, a computer system, such as a laptop, may also be used for communication with the web server.

At step 1340, an EP that contains a unique enablement key linked with the lighting appliance may be provided to the mobile device or computer system. The web server may access a database, such as database 506, and retrieve a unique enablement key that is linked with the particular lighting appliance which will receive the EP. The unique enablement key retrieved by the web server may be required to not have been previously used for an EP at the lighting appliance. As such, each unique key may only be used for a single EP. After a unique enablement key has been used for an EP, the unique enablement key may be marked as used by the web server. Accordingly, at step 1340, the mobile device or computer system that is to transfer the EP to the lighting appliance may now have an EP that contains a unique enablement key associated with the particular lighting appliance that is to receive the EP. At step 1340, this EP may be transferred to the lighting appliance; this transfer may be wireless or via a communication cable.

At step 1350, the validity of the enablement period that contains the unique enablement key at step 1340 may be checked by the receiving lighting appliance. The lighting appliance may compare the received unique enablement key to the unique enablement keys that were programmed into the lighting appliance at step 1310. If the unique enablement key received matches one of the stored enablement keys, the EP may be determined to be valid. In some embodiments, the lighting appliance may only accept a particular unique enablement key once. As such, the lighting appliance may store a record of which unique enablement keys have or have not yet been used. If the EP is valid, at step 1360, the count of unactivated enablement periods stored by the receiving lighting appliance may be updated (e.g., increased by one). If the EP is determined to not be valid at step 1350 (for example, the EP does not match to an unused unique enablement key stored by the lighting appliance that is not yet been used), the current count of unactivated enablement periods may not be increased or otherwise updated by the receiving lighting appliance at step 1370. In some embodiments, invalid EPs may be ignored and thus have no effect. In other embodiments, if the EP is determined to be invalid, this may be evidence of tampering and the lighting appliance may be disabled. Disabling such of receiving lighting appliance may include temporarily disabling it for a predefined period of time, permanently disabling it, or disabling it until a reactivation input is provided by an authorized user.

To further illustrate one way in which method 1300 may be applied in an example embodiment of a study lamp for students, the following steps may be taken: a lighting appliance may be programmed with four lamp-specific unique one-time enablement keys at step 1310 and may initially be set to a first mode in which use is controlled based on EPs. These keys may be based upon, at least in part, unique information associated with the lamp such as the unique MAC address (Media Access Control Address) of a Bluetooth® System on a Chip Module. In this example, four different unique enablement keys may be stored at step 1320 to each lighting appliance. For each light, each key may be associated with a one week enablement period. An agent of the school such as a headmaster or other school staff member may request an enablement period of seven days. The enablement period may be programmed to begin immediately upon successful transfer of the EP to the lighting appliance. During the week of the activated enablement period, the lamp may be used as much as desired to provide light for study or to charge another device, such as a mobile phone. Once the activated enablement period has elapsed, another EP period may need to be transferred to enable continued use until a designated number of EPs, for example four one-week EPs, have been transferred to permit the lighting appliance to operate in a second mode that permits unlimited use of the appliance.

Figure 14:
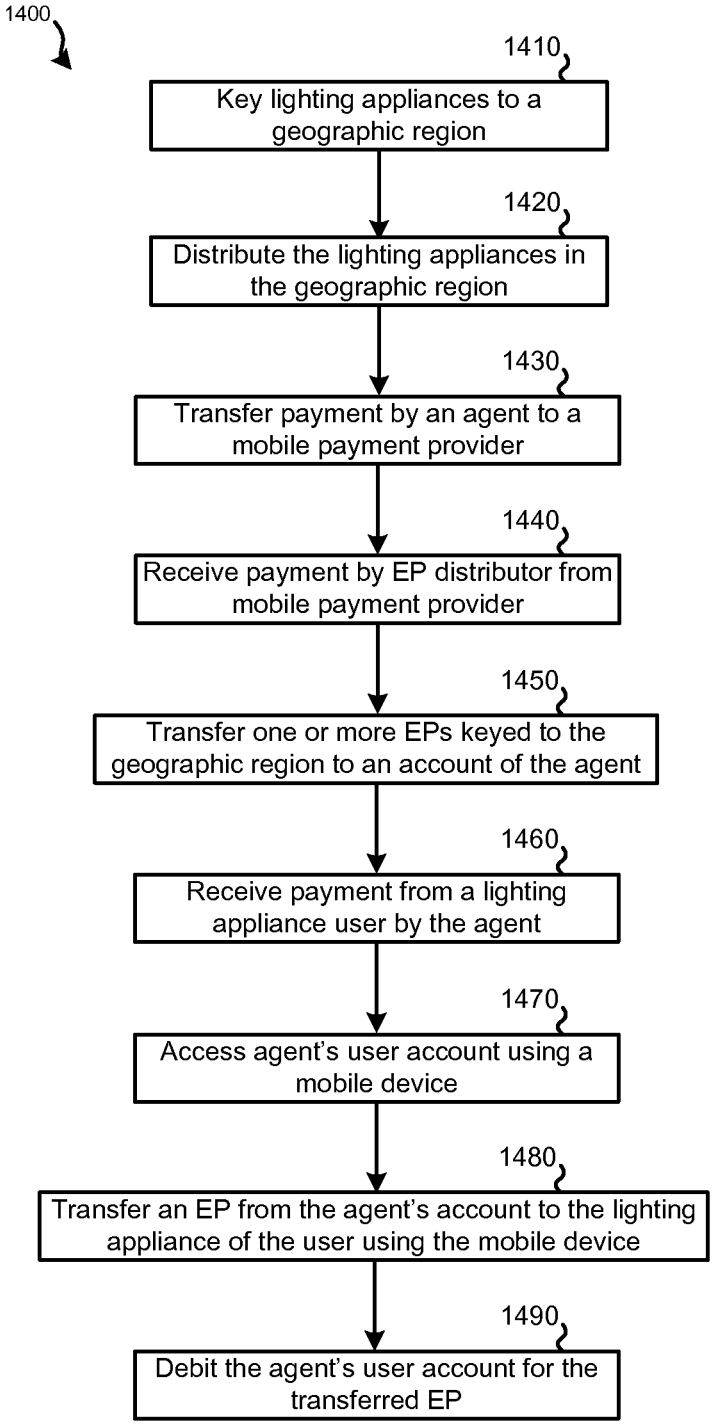
FIG. 14 illustrates an embodiment of a method for using geographic region keyed enablement periods.

FIG. 14 illustrates an embodiment of a method 1400 for using geographic region keyed enablement periods. Method 1400 may be performed using a mobile device, such as a cellular phone (which may be a smart phone), a tablet computer, laptop computer or some other form of mobile device that is configured to access a remotely stored user account that stores enablement periods. Method 1400 may be used for acquiring one or more enablement periods in an account of an agent and/or for transferring one or more enablement periods from the account of the agent to lighting appliances of users. The transfer from the agent's account to the lighting appliance may occur via a mobile device operated by the agent. Means for performing the steps of method 1400 include one or multiple instances of components of solar-powered lighting appliance system 300, one or more processors, computer systems, mobile devices, and/or one or more non-transitory storage mediums.

In method 1400, an agent may be a person who purchases and resells (or otherwise distributes) enablement periods and/or lighting appliances. For example, to further illustrate an example embodiment related to study lamps for students described above with respect to FIG. 13, the agent may be a headmaster of a school. In some instances, it may be efficient for the headmaster to serve as an agent due to a large number of students needing access to lighting, such as for reading and studying in the evening. Further, in method 1400, the user refers to an end-user of a lighting appliance. A user, such as a student, may purchase from or be given by the agent one or more enablement periods. As such, in the school-based scenario, a student may acquire one or more enablement periods from a headmaster for a lighting appliance owned, borrowed, or otherwise used by the student.

At step 1410, multiple lighting appliances, such as the previously described solar powered lighting appliances, may be keyed to a particular geographic region. By keying lighting appliances to a particular geographic region, enablement periods that can be transferred to the lighting appliance (and activated by the lighting appliance) also need to be keyed to the particular geographic region to which the lighting appliances are keyed. In some situations, this may allow various geographic/economic regions to be isolated from each other for distribution of EPs. As an example, geographic regions may be defined on a country by country basis. Referring to Africa, the country of Namibia may represent a separate geographic region from other countries in Africa, such as Kenya. Therefore, for an enablement period to be able to be loaded onto a lighting appliance keyed to Namibia, the enablement period would likewise need to be keyed to Namibia. Such keying may allow different prices to be set for EPs in different regions. In some embodiments, rather than geographic regions being defined on a country by country basis, larger (e.g., multiple country regions or continental) or smaller geographic regions may be defined. For example, a smaller geographic region may refer to a particular county, village, city, or some other division. Such geographic regions may be useful to prevent or limit piracy of EPs. For example, if a person in a particular village identifies a way to create "fake" EPs, these EPs may only work in his region and may be useless in regions that require differently keyed EPs. Moreover, in some embodiments, geographic regions may overlap to a desired degree to accommodate a plurality of distributors to service one region.

While method 1400 discloses lighting appliances and EPs being keyed to particular geographic regions, it should be understood that method 1400 may be performed without such keying. As such, in other embodiments of method 1400, enablement periods may be transferred to lighting appliances regardless of any geographic region keying.

At step 1420, the lighting appliances keyed to the geographic region at step 1410 may be distributed within the geographic region. For example, lighting appliances keyed to receive Namibian-keyed enablement periods may be distributed only within Namibia. Distribution may occur via an agent who also may sell or otherwise distribute enablement periods. Distribution of the lighting appliances at step 1420 may occur for free or for a price. For example, a schoolmaster may distribute lights free of charge to students. (However, students may be required to purchase enablement periods.)

At step 1430, an agent that is to sell or otherwise distribute enablement periods may first need to acquire the enablement periods. This agent may be the agent that distributed the lighting appliances at step 1420. At step 1430, using a mobile device, funds may be transferred to an account of an enablement period distributor that sells enablement periods. The distributor that sells enablement periods may also be the entity from which the lighting appliances were received for distribution by the agent at step 1420. As such, the distributor may, rather than (or in addition to) earning revenue on the sale of the lighting appliances may earn revenue on the sale of enablement periods. The agent may transfer funds via a mobile payment provider to an account of the enablement period distributor. For example, one entity that performs mobile payments is M-Pesa operating in Kenya. The transfer of funds may be performed using a same mobile device that will later be used to transfer enablement periods to lighting appliances. In some embodiments, rather than sending money through a mobile payment provider, money may be transferred directly to the distributor of the EPs, such as via a transaction card based purchase made with the distributor.

At step 1440, the payment sent through the mobile payment provider may be received by the enablement period distributor from the mobile payment provider. In some embodiments, this may involve some or all of the funds from the transfer of step 1430 being deposited in an account of the EP distributor maintained by the mobile payment provider at step 1440.

At step 1450, in response to the payment being successfully received at step 1440, one or more enablement periods may be transferred to an account of the agent maintained by the distributor. For example, referring to system 500, the enablement periods may be managed and stored in the agent's user account at web server 504. The number of enablement periods credited to the agent's account may be based on the amount of money transferred to the distributor via the mobile payment provider. The one or more EPs credited to the agent's account may be keyed to the particular geographic region with which the agent is associated. This geographic region may be the same geographic region in which the lighting appliances was distributed at step 1420. Once the one or more enablement periods that are keyed to the geographic region of the agent are in the user account of the agent, the agent may transfer these enablement periods to lighting appliances via the agent's mobile device.

At step 1460, the agent may receive payment from the lighting appliance user. Such payment may be for one or more enablement periods. Payment may be received by the agent in whatever form the agent requests. For example, cash or barter may be received by the agent. In some situations, the agent may give away the enablement periods. For example, a schoolmaster may provide free enablement periods to students. In such situations, funds for the enablement periods may be received from a third party, such as a nonprofit organization. In other situations, the schoolmaster may sell the enablement periods to students and the students' families. In some situations, a mobile payment provider may also be used by the lighting appliance user to transfer funds to an account of the agent. If the agent is selling enablement periods in order to make a profit, the price at which the agent sells enablement periods may be greater than the amount paid by the agent for the enablement periods at step 1430. In the schoolmaster-student arrangement, each EP may provide a one week period of lighting appliance enablement.

Following receiving payment for one or more enablement periods (or prior to receiving payment, if the agent decides to extend credit to the lighting appliance user), the agent may access his user account from the agent's mobile device at step 1470. This may involve the agent logging in to his user account using a username and password. Accessing the agents user account may be performed as described in relation to FIG. 7. By the agent accessing his user account via his mobile device, the agent may have access to previous purchased or otherwise acquired enablement periods.

At step 1480, the agent may transfer one or more enablement periods from the agent's account to a lighting appliance of the user. The enablement period may be transferred using the mobile device of the agent. For example, the mobile device may be used to log into the agent's user account, access purchased enablement periods, and transfer one or more enablement periods to the lighting appliance. The lighting appliance may be in wireless communication (e.g., Bluetooth®) or may communicate via one or more wires with the mobile device of the agent. For an EP to be successfully transferred from the mobile device to the lighting appliance, the EP may need to be keyed to the same geographic region as the lighting appliance. For example, an identifier of the EP may be required to match an alphanumeric string that is also stored by the lighting appliance. If the enablement period and the lighting appliance are keyed to different geographic regions, the transfer may be blocked. In some embodiments, such a transfer involving enablement periods and lighting appliances associated with different geographic regions may result in the agent's user account and/or the lighting appliance being locked from use for a period of time or until an administrator reactivates the user account and/or the lighting appliance. Once the EP has been transferred to the lighting appliance, the EP may be activated at the lighting appliance in order to enable use of the light of the lighting appliance or, in some embodiments, may be transferred to another lighting appliance (that is also keyed to the same geographic region).

At step 1490, following successful transfer of the EP to the lighting appliance at step 1480, the agent's user account may be debited for the enablement period that was successfully transferred. Therefore, via the mobile device of the agent, the enablement period was transferred from a user account of the agent to a user's lighting appliance. Such an arrangement may be beneficial in a situation where few people have access to a mobile device in order to purchase enablement periods. As such, rather than the user of the lighting appliance purchasing an enablement period directly using his own mobile device, the mobile device of an agent may be used to purchase one or more enablement periods and then have one or more enablement period transferred to lighting appliances associated with various users. For the schoolmaster-student example, since students tend to attend class multiple times during a week, sufficient exposure to the schoolmaster may be present to purchase (or otherwise acquire) EPs as needed.

Figure 15:
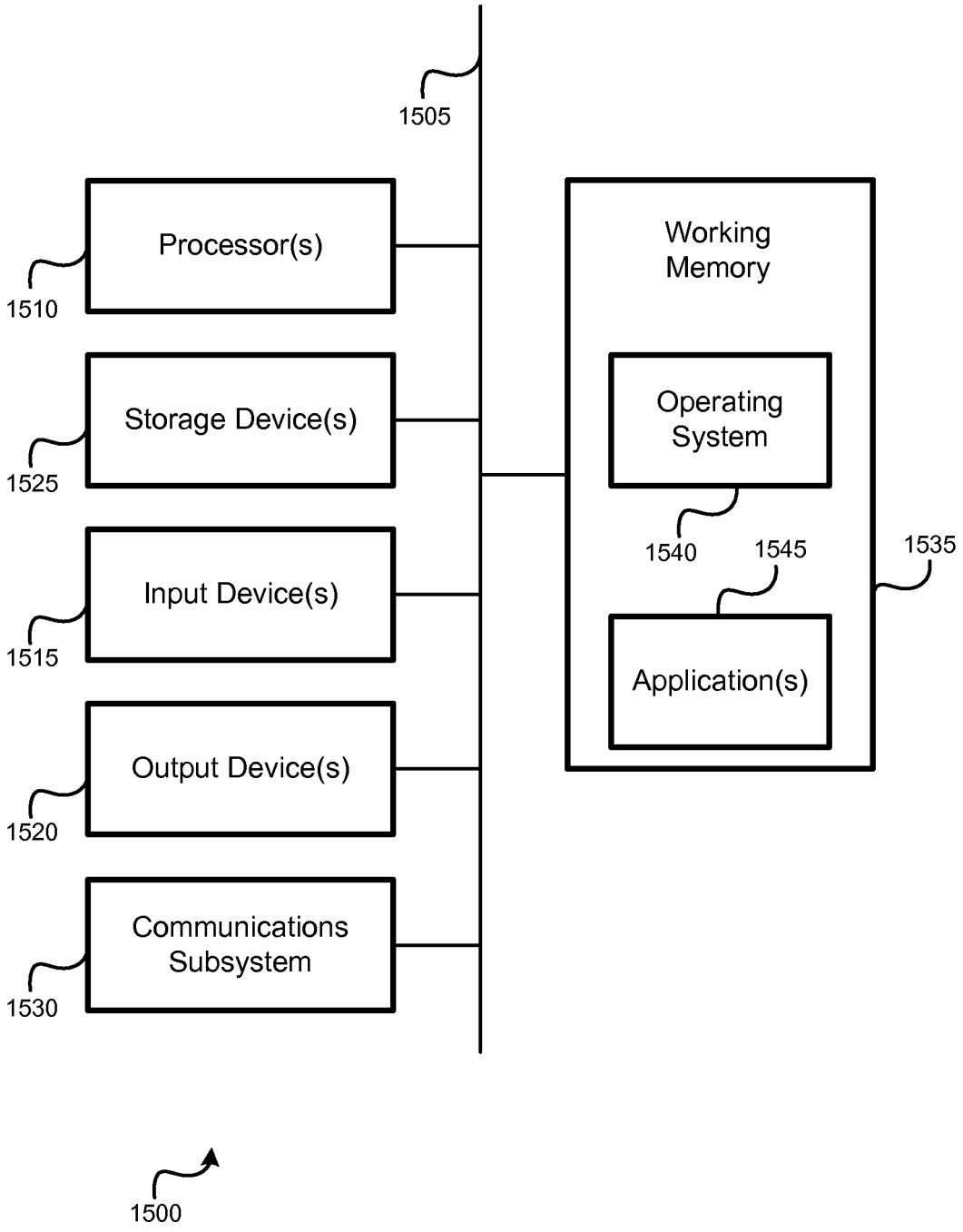
FIG. 15 illustrates an embodiment of a computer system.

A computer system as illustrated in FIG. 15 may be incorporated as part of the previously-described computerized devices. For example, computer system 1500 can represent some of the components of the mobile devices and/or the computer systems discussed in this application. FIG. 15 provides a schematic illustration of one embodiment of a computer system 1500 that can perform the methods provided by various other embodiments, as described herein. It should be noted that FIG. 15 is meant only to provide a generalized illustration of various components, any or all of which may be utilized as appropriate. FIG. 15, therefore, broadly illustrates how individual system elements may be implemented in a relatively separated or relatively more integrated manner.

The computer system 1500 is shown comprising hardware elements that can be electrically coupled via a bus 1505 (or may otherwise be in communication, as appropriate). The hardware elements may include one or more processors 1510, including without limitation one or more general-purpose processors and/or one or more special-purpose processors (such as digital signal processing chips, graphics acceleration processors, and/or the like); one or more input devices 1515, which can include without limitation a mouse, a keyboard, and/or the like; and one or more output devices 1520, which can include without limitation a display device, a printer, and/or the like.

The computer system 1500 may further include (and/or be in communication with) one or more non-transitory storage devices 1525, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

The computer system 1500 might also include a communications subsystem 1530, which can include without limitation a modem, a network card (wireless or wired), an infrared communication device, a wireless communication device, and/or a chipset (such as a Bluetooth™ device, an 802.11 device, a WiFi device, a WiMax device, cellular communication facilities, etc.), and/or the like. The communications subsystem 1530 may permit data to be exchanged with a network (such as the network described below, to name one example), other computer systems, and/or any other devices described herein. In many embodiments, the computer system 1500 will further comprise a working memory 1535, which can include a RAM or ROM device, as described above.

The computer system 1500 also can comprise software elements, shown as being currently located within the working memory 1535, including an operating system 1540, device drivers, executable libraries, and/or other code, such as one or more application programs 1545, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be stored on a non-transitory computer-readable storage medium, such as the storage device(s) 1525 described above. In some cases, the storage medium might be incorporated within a computer system, such as computer system 1500. In other embodiments, the storage medium might be separate from a computer system (e.g., a removable medium, such as a compact disc), and/or provided in an installation package, such that the storage medium can be used to program, configure, and/or adapt a general purpose computer with the instructions/code stored thereon. These instructions might take the form of executable code, which is executable by the computer system 1500, and/or might take the form of source and/or installable code, which, upon compilation and/or installation on the computer system 1500 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 1500) to perform methods in accordance with various embodiments of the invention. According to a set of embodiments, some or all of the procedures of such methods are performed by the computer system 1500 in response to processor 1510 executing one or more sequences of one or more instructions (which might be incorporated into the operating system 1540 and/or other code, such as an application program 1545) contained in the working memory 1535. Such instructions may be read into the working memory 1535 from another computer-readable medium, such as one or more of the storage device(s) 1525. Merely by way of example, execution of the sequences of instructions contained in the working memory 1535 might cause the processor(s) 1510 to perform one or more procedures of the methods described herein.

The terms "machine-readable medium" and "computer-readable medium," as used herein, refer to any medium that participates in providing data that causes a machine to operate in a specific fashion. In an embodiment implemented using the computer system 1500, various computer-readable media might be involved in providing instructions/code to processor(s) 1510 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 1525. Volatile media include, without limitation, dynamic memory, such as the working memory 1535.

Common forms of physical and/or tangible computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 1510 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 1500.

The communications subsystem 1530 (and/or components thereof) generally will receive signals, and the bus 1505 then might carry the signals (and/or the data, instructions, etc. carried by the signals) to the working memory 1535, from which the processor(s) 1510 retrieves and executes the instructions. The instructions received by the working memory 1535 may optionally be stored on a storage device 1525 either before or after execution by the processor(s) 1510.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered. Accordingly, the above description does not bind the scope of the claims.

What is claimed is:

1. A rechargeable lighting appliance, comprising:
- a light;
- a rechargeable battery connected with the light;
- a communication interface configured to receive an enablement period, wherein the enablement period indicates a period of time of a predetermined duration during which one or more functions of the rechargeable lighting appliance are enabled for use;
- a non-transitory machine-readable storage device configured to store the enablement period;
- one or more processors, configured to:
  - control a mode of the rechargeable lighting appliance, wherein:
    - the mode is configured to be set to a first mode or a second mode;
    - the first mode permits illumination of the light at least partially based on activation of the enablement period stored by the non-transitory machine-readable storage device; and
    - the second mode allows for illumination of the light without activation of the enablement period; and
- a short-range transceiver, configured to:
  - permit the enablement period to be transferred from the rechargeable lighting appliance to a second rechargeable lighting appliance, wherein:
    - the communication interface comprises the short-range transceiver;
    - transfer of the enablement period stored by the non-transitory machine-readable storage device is permitted if the enablement period has not been activated by the rechargeable lighting appliance; and
    - following transfer from the rechargeable lighting appliance to the second rechargeable lighting appliance, the one or more processors are configured such that:
      - the enablement period is not available for activation by the rechargeable lighting appliance.

2. The rechargeable lighting appliance of claim 1, wherein the light, when illuminated, has a brightness of at least 20 lumens.

3. The rechargeable lighting appliance of claim 1, wherein, when the rechargeable lighting appliance is in the first mode:
- activation of the enablement period stored by the non-transitory machine-readable storage device permits use of the light for a predefined period of time; and
- use of the light is not permitted unless the enablement period is activated.

4. The rechargeable lighting appliance of claim 3, further comprising:
- an external device charging connection, wherein
  - when the rechargeable lighting appliance is in the first mode:
    - activation of the enablement period stored by the non-transitory machine-readable storage device permits use of the external device charging connection for a predefined period of time; and
    - use of the external device charging connection is not permitted unless the enablement period is activated.

5. The rechargeable lighting appliance of claim 1, wherein:
the communication interface is configured to receive the enablement period as an encrypted enablement period;
the one or more processors are further configured to:
prior to receiving the encrypted enablement period, provide a random number to a mobile device that is to provide the encrypted enablement period; and
after receiving the encrypted enablement period via the communication interface, decrypt the encrypted enablement period using the random number and an encryption key stored locally by the rechargeable lighting appliance, wherein:
the encrypted enablement period is encrypted using the random number; and
the encryption key is not transmitted between the mobile device and the rechargeable lighting appliance.

6. The rechargeable lighting appliance of claim 1, wherein the
short-range transceiver is further configured to:
receive the enablement period from a mobile device, wherein
the one or more processors are further configured such that:
the enablement period is available for activation by the rechargeable lighting appliance following receipt of the enablement period from the mobile device.

7. The rechargeable lighting appliance of claim 6, wherein the mobile device is a cellular telephone.

8. The rechargeable lighting appliance of claim 1, wherein, at manufacture, a plurality of enablement keys are stored to the non-transitory machine-readable storage device, wherein the plurality of enablement keys are unique from enablement keys of other rechargeable lighting appliances; and
the one or more processors are further configured to permit activation of the enablement period only if the enablement period indicates an enablement key of the plurality of enablement keys.

9. The rechargeable lighting appliance of claim 1, wherein the one or more processors are further configured to:
enter the second mode from the first mode after a threshold number of enablement periods have been activated on the rechargeable lighting appliance; and
once the second mode is entered based on the threshold number of activations of enablement periods being met, the rechargeable lighting appliance remains permanently in the second mode.

10. The rechargeable lighting appliance of claim 9, wherein the non-transitory machine-readable storage device is further configured to store a total number of enablement periods activated on the rechargeable lighting appliance.

11. The rechargeable lighting appliance of claim 1, further comprising:
an accelerometer, in communication with the one or more processors, wherein the one or more processors are configured, based on data received from the accelerometer, to detect an actuation action performed using the rechargeable lighting appliance.

12. The rechargeable lighting appliance of claim 11, wherein the actuation action comprises tipping the rechargeable lighting appliance within communication range of the second rechargeable lighting appliance.

13. The rechargeable lighting appliance of claim 1, further comprising:
a solar panel configured to recharge the rechargeable battery.

14. The rechargeable lighting appliance of claim 1, wherein the rechargeable lighting appliance is waterproof.

15. A method for controlling use of a rechargeable lighting appliance, the method comprising:
setting the rechargeable lighting appliance to a first mode, wherein:
the first mode permits illumination of a light of the rechargeable lighting appliance at least partially based on activation of an enablement period stored by a non-transitory machine-readable storage device of the rechargeable lighting appliance, wherein the enablement period indicates a predefined period of time during which one or more functions of the rechargeable lighting appliance are enabled for use;
receiving, by the rechargeable lighting appliance, the enablement period;
storing, by the rechargeable lighting appliance, the enablement period;
receiving, by the rechargeable lighting appliance, user input that indicates to activate the enablement period;
enabling, by the rechargeable lighting appliance, use of the light for the predetermined period of time at least partially based on activation of the enablement period;
receiving, by the rechargeable lighting appliance, a second enablement period;
receiving, by the rechargeable lighting appliance, user input that indicates to transfer the second enablement period to a second rechargeable lighting appliance; and
transferring, by the rechargeable lighting appliance, the second enablement period to the second rechargeable lighting appliance, wherein:
following the transfer, the second enablement period is not available for activation by the rechargeable lighting appliance; and
following the transfer, the second enablement period is available for activation by the second rechargeable lighting appliance.

16. The method for controlling use of the rechargeable lighting appliance of claim 15, further comprising:
enabling, by the rechargeable lighting appliance, use of an external device charging connection for a predetermined period of time at least partially based on activation of the enablement period.

17. The method for controlling use of the rechargeable lighting appliance of claim 15, wherein the enablement period is received from a cellular phone via a wireless communication protocol.

18. The method for controlling use of the rechargeable lighting appliance of claim 15, further comprising:
following receiving the enablement period, increasing, by the rechargeable lighting appliance, an available enablement period count; and
following activation of the enablement period, decreasing, by the rechargeable lighting appliance, the available enablement period count.

19. The method for controlling use of the rechargeable lighting appliance of claim 18, further comprising:
while in the first mode, tracking, by the rechargeable lighting appliance, an amount of time since the enablement period was activated; and
while in the first mode, disabling, by the rechargeable lighting appliance, following expiration of the predetermined period of time, availability of the light for illumination.

20. The method for controlling use of the rechargeable lighting appliance of claim 19, further comprising:

following enabling use of the light for the predetermined period of time at least partially based on the activation of the enablement period, increasing, by the rechargeable lighting appliance, a lifetime activated enablement period count, wherein the lifetime activated enablement period count indicates a total number of enablement periods that have been activated on the rechargeable lighting appliance.

21. A lighting apparatus, comprising:

means for lighting;

means for setting the lighting apparatus to a first mode, wherein:

the first mode permits illumination of the means for lighting at least partially based on activation of an enablement period, wherein the enablement period indicates a predetermined time period during which one or more functions of the lighting apparatus are enabled for use;

means for receiving a first enablement period;

means for storing the first enablement period;

means for receiving user input that indicates to activate the first enablement period;

means for enabling use of the light for the predetermined time period at least partially based on activation of the first enablement period;

means for receiving a second enablement period after the first enablement period is received;

means for storing the second enablement period;

means for receiving user input that indicates to transfer the second enablement period to a second lighting apparatus; and means for transferring the second enablement period to the second lighting apparatus, wherein:

following the transfer, the second enablement period is not available for activation by the lighting apparatus; and following the transfer, the second enablement period is available for activation by the second lighting apparatus.

* * * * *